US011478913B2

(12) United States Patent
Yagi et al.

(10) Patent No.: US 11,478,913 B2
(45) Date of Patent: Oct. 25, 2022

(54) STAPLE REMOVING DEVICE

(71) Applicant: MAX CO., LTD., Tokyo (JP)

(72) Inventors: Nobuaki Yagi, Tokyo (JP); Katsuya Hakozaki, Tokyo (JP)

(73) Assignee: MAX CO., LTD., Tokyo (JP)

( * ) Notice: Subject to any disclaimer, the term of this patent is extended or adjusted under 35 U.S.C. 154(b) by 92 days.

(21) Appl. No.: 17/065,130

(22) Filed: Oct. 7, 2020

(65) Prior Publication Data

US 2021/0101270 A1 Apr. 8, 2021

(30) Foreign Application Priority Data

Oct. 7, 2019 (JP) ..... JP2019-184851

(51) Int. Cl.
*B25C 11/00* (2006.01)

(52) U.S. Cl.
CPC ..... *B25C 11/00* (2013.01)

(58) Field of Classification Search
CPC ..... B25C 11/00; B65H 41/00
See application file for complete search history.

(56) References Cited

FOREIGN PATENT DOCUMENTS

| | | | |
|---|---|---|---|
| JP | 2000246668 | A | 9/2000 |
| JP | 2019-022923 | A | 2/2019 |
| WO | 2019116426 | A1 | 6/2019 |

OTHER PUBLICATIONS

The extended EP Search Report for 20200338.0 filed Feb. 18, 2021, (6 pages).

*Primary Examiner* — Nirvana Deonauth
(74) *Attorney, Agent, or Firm* — Weihrouch IP

(57) ABSTRACT

A staple removing device includes: a placement part on which a bundle of paper bound with a staple can be placed; a paper pressing part that is configured to be movable toward the bundle of paper, and presses the bundle of paper against the placement part by movement; a removal part that is configured to be insertable between the bundle of paper and the staple, and removes the staple from the bundle of paper by the insertion; a load detecting part that detects an insertion load of the removal part when the removal part is inserted between the bundle of paper and the staple; and a control part that adjusts a pressing force of the paper pressing part based upon the insertion load detected by the load detecting part.

25 Claims, 19 Drawing Sheets

STAPLE REMOVING DEVICE

CROSS REFERENCE TO RELATED APPLICATIONS

This application claims priority to Japanese Patent Application No. 2019-184851 filed on Oct. 7, 2019, the content of which is incorporated herein by reference.

TECHNICAL FIELD

The present disclosure relates to a staple removing device.

BACKGROUND ART

In a related art, disclosed is a staple removing device for removing a staple from a bundle of paper (for example, refer to JP-A-2019-022923). Such type of staple removing device removes the staple from the bundle of paper by inserting a wedge-shaped plate (hereinafter referred to as a wedge plate) between the bundle of paper and the staple. Generally, in the staple removing device, a paper pressing mechanism for pressing the bundle of paper at a predetermined position on a placement part is provided in order to prevent movement (shift) of the bundle of paper when the wedge plate is inserted between the bundle of paper and the staple.

For example, the staple removing device disclosed in JP-A-2019-022923 includes a pressing plate that is energized by a spring in a direction of pressing the bundle of paper, moves downward, and presses the bundle of paper to a removal set position.

In the staple removing device disclosed in JP-A-2019-022923, a pressing force of the pressing plate against the bundle of paper is set to a constant value at all time. The pressing force is set to be equal to or greater than a force capable of pressing down the maximum number of sheets of the bundle of paper in which binding processing that requires the maximum pressing force is performed. However, here, for example, with respect to a bundle of paper that does not require a significant pressing force such as a thin bundle of paper including two or three sheets of paper, the above-described bundle of paper is pressed with the significant pressing force that can prevents movement of maximum number of sheets of the bundle of paper, thereby resulting in poor energy efficiency. Even though the number of sheets of the bundle of paper is the same, for example, an insertion load when the wedge plate is inserted between the bundle of paper and the staple becomes different depending on a type of paper, a type of staple, and a binding state of the staple to the bundle of paper (for example, when the staple strongly binds the bundle of paper to bite into the paper). Therefore, even though the pressing force is set according to the maximum number of sheets of the bundle of paper, the insertion load of the wedge plate may exceed expectations and the bundle of paper may be shifted, depending on the type of paper, the type of staple, and the binding state of the staple to the bundle of paper.

SUMMARY OF INVENTION

Therefore, an object of the present disclosure is to provide a staple removing device capable of fixing various types of a bundle of paper at a predetermined position with an optimum pressing force.

According to an aspect of the present disclosure, a staple removing device includes: a placement part on which a bundle of paper bound with a staple including a crown part and a leg part can be placed; a paper pressing part that is provided at a position facing the bundle of paper placed on the placement part, configured to be movable toward the bundle of paper, and presses the bundle of paper against the placement part by movement; a removal part that is disposed on a side where the crown part of the bundle of paper placed on the placement part is exposed, configured to be insertable between the bundle of paper and the staple, and removes the staple from the bundle of paper by insertion; a load detecting part that detects an insertion load of the removal part when the removal part is inserted between the bundle of paper and the staple; and a control part that adjusts a pressing force of the paper pressing part based upon the insertion load detected by the load detecting part.

According to another aspect of the present disclosure, a staple removing device includes: a placement part on which a bundle of paper bound with a staple including a crown part and a leg part can be placed; a paper pressing part that is provided at a position facing the bundle of paper placed on the placement part, configured to be movable toward the bundle of paper, and presses the bundle of paper against the placement part by movement; a removal part that is disposed on a side where the crown part of the bundle of paper placed on the placement part is exposed, configured to be insertable between the bundle of paper and the staple, and removes the staple from the bundle of paper by insertion; a thickness detecting part that detects a thickness of the bundle of paper placed on the placement part; and a control part that adjusts a pressing force of the paper pressing part based upon the thickness of the bundle of paper detected by the thickness detecting part.

According to a staple removing device of the present disclosure, since a pressing force of a paper pressing part against a bundle of paper is adjusted based upon an insertion load of a removal part when the removal part is inserted between the bundle of paper and a staple or a thickness of the bundle of paper, the bundle of paper can be pressed with an optimum pressing force by the paper pressing part according to a type of the bundle of paper.

DESCRIPTION OF EMBODIMENTS

First Embodiment

[Configuration Example of Staple Removing Device 1A]

Figure 1A:
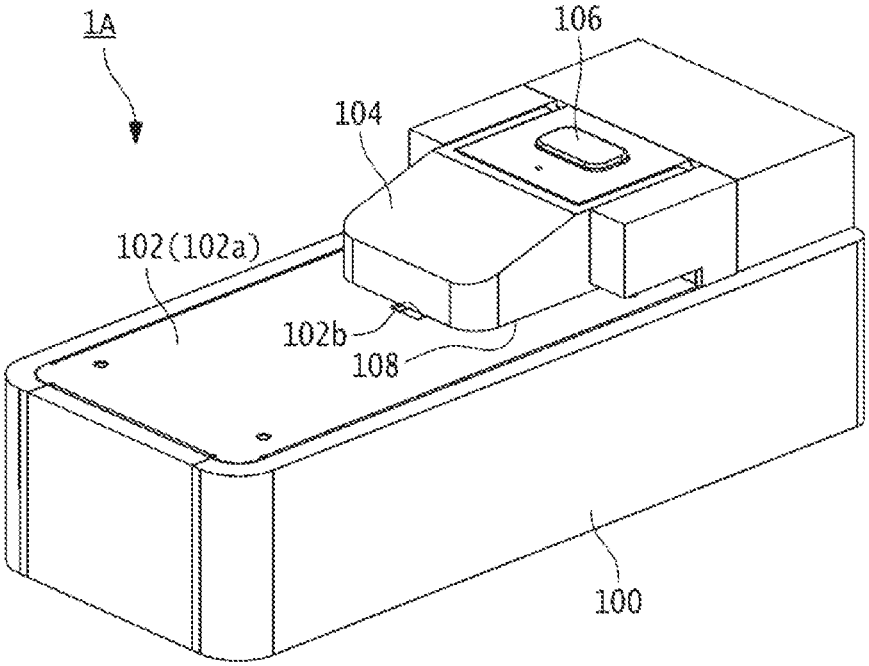
FIG. 1A is a front perspective view of a staple removing device according to a first embodiment.
Figure 1B:
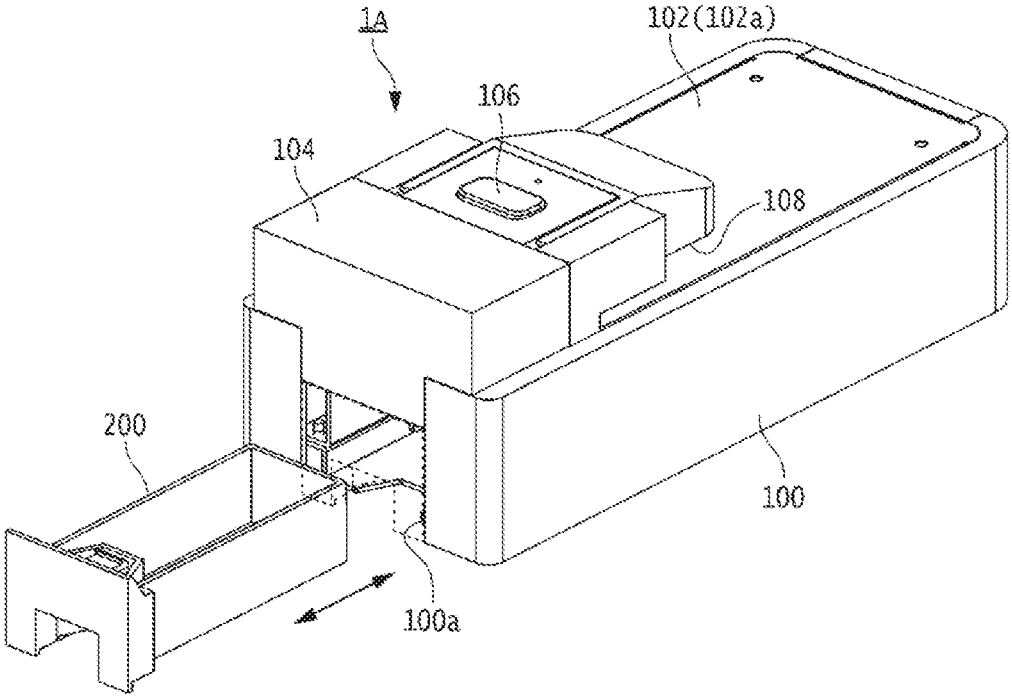
FIG. 1B is a rear perspective view of the staple removing device according to the first embodiment.
Figure 2A:
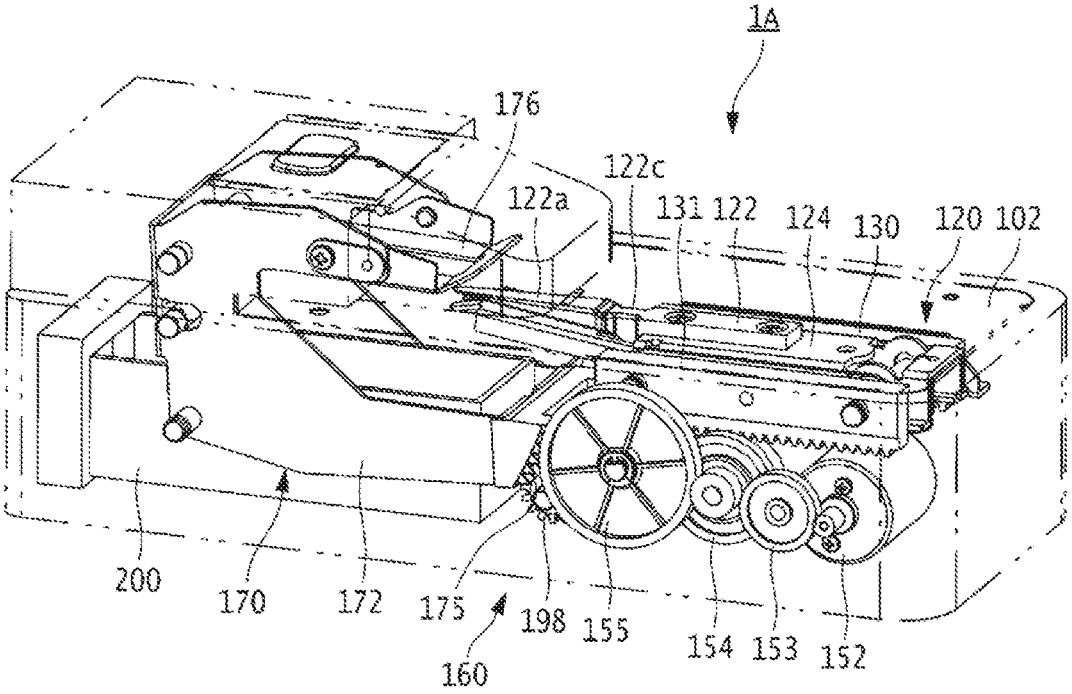
FIG. 2A is a perspective view of the inside of the staple removing device according to the first embodiment when viewed from the right side.
Figure 2B:
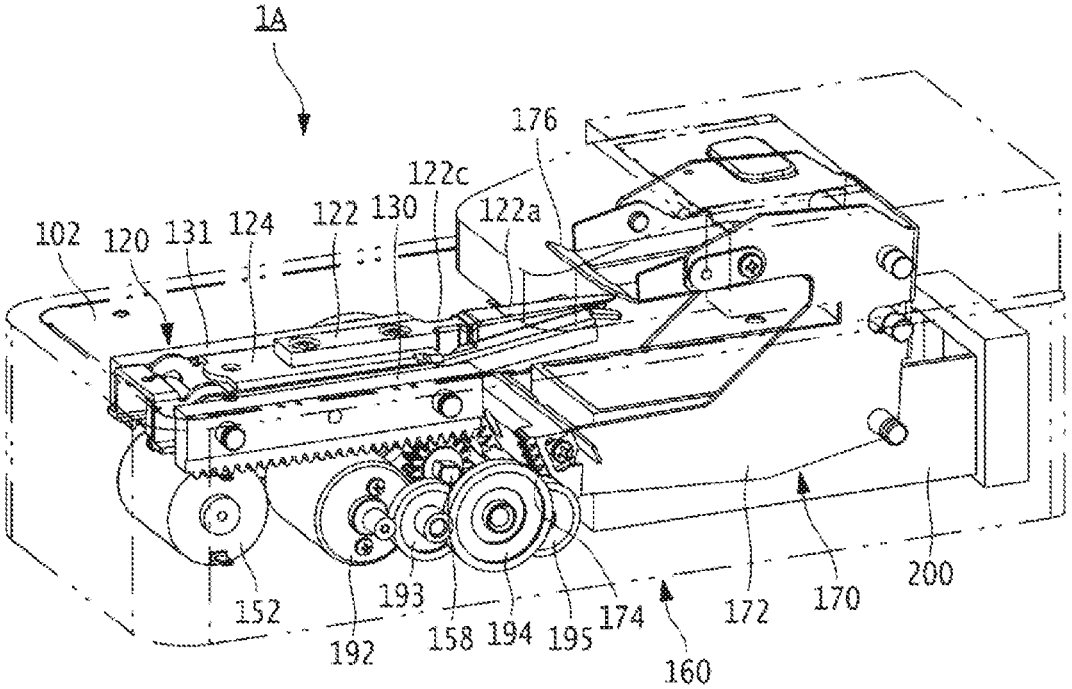
FIG. 2B is a perspective view of the inside of the staple removing device according to the first embodiment when viewed from the left side.
Figure 3:
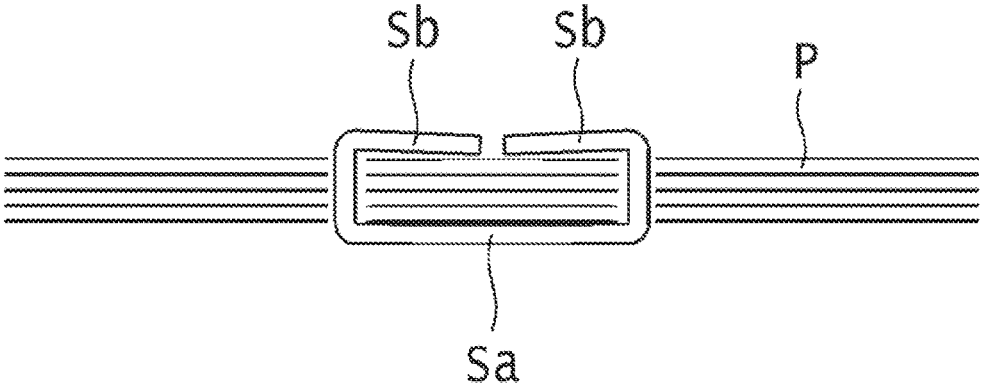
FIG. 3 is a diagram illustrating a state of a staple for binding a bundle of paper.
Figure 4:
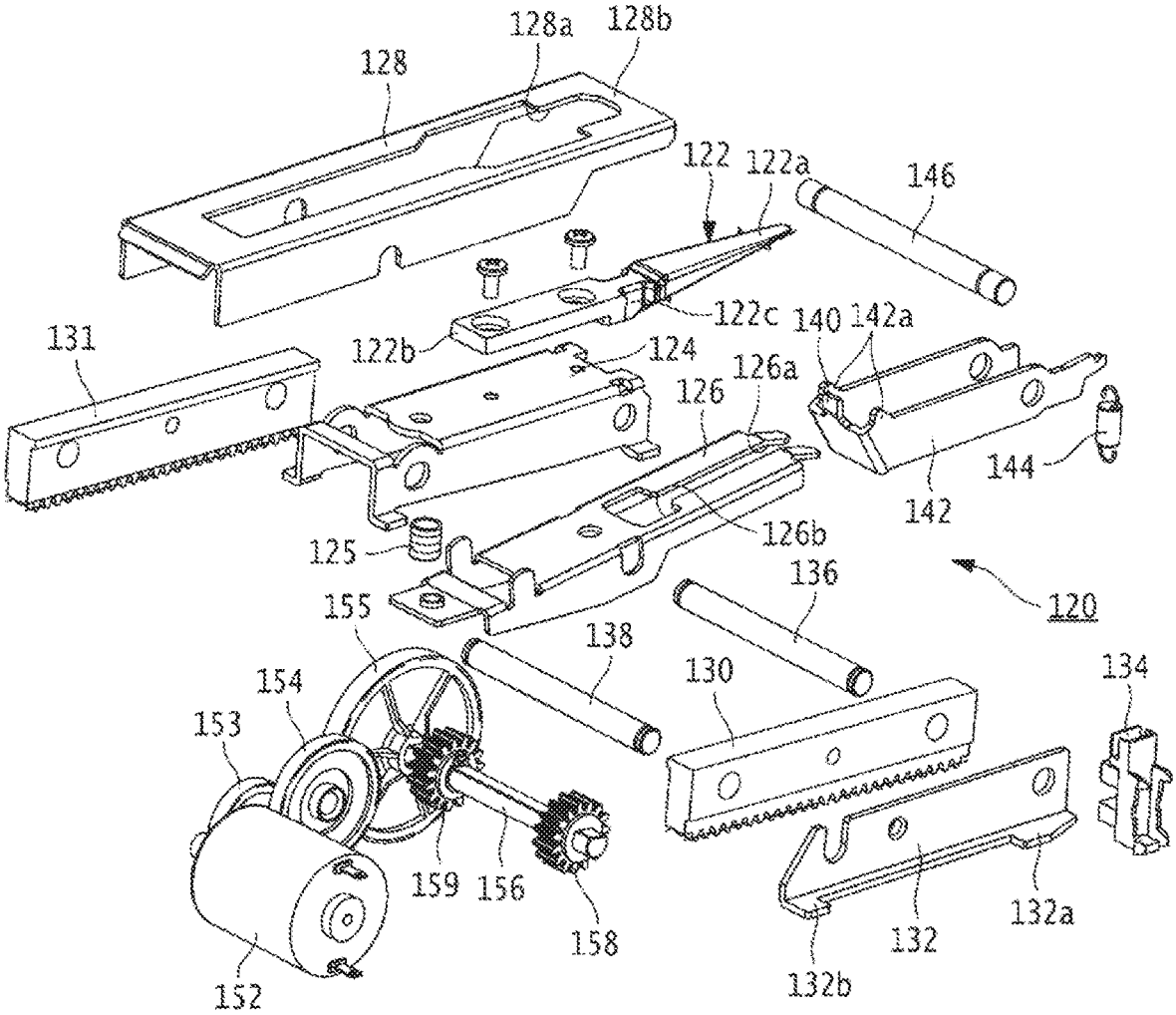
FIG. 4 is an exploded perspective view of a staple removing mechanism according to the first embodiment.
Figure 5:
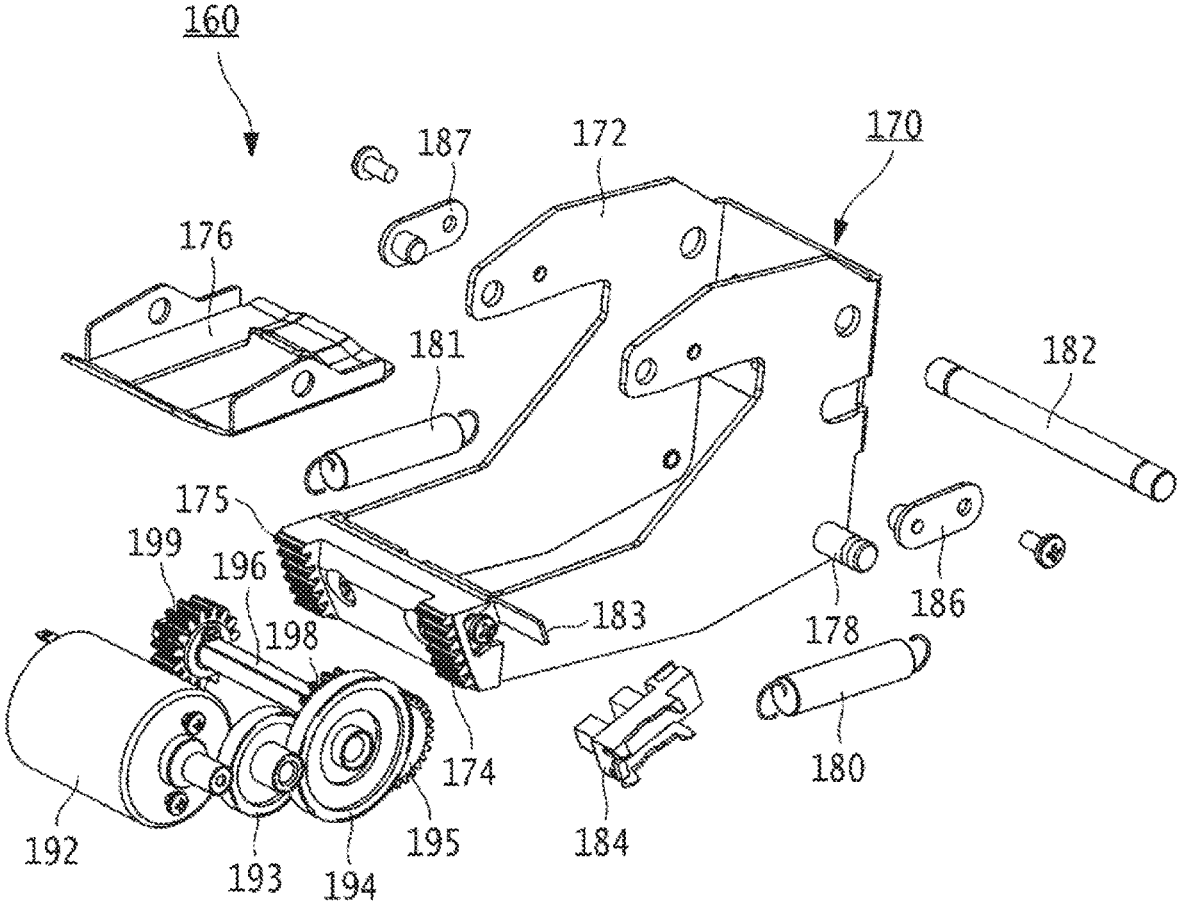
FIG. 5 is an exploded perspective view of a paper pressing mechanism according to the first embodiment.
Figure 6:
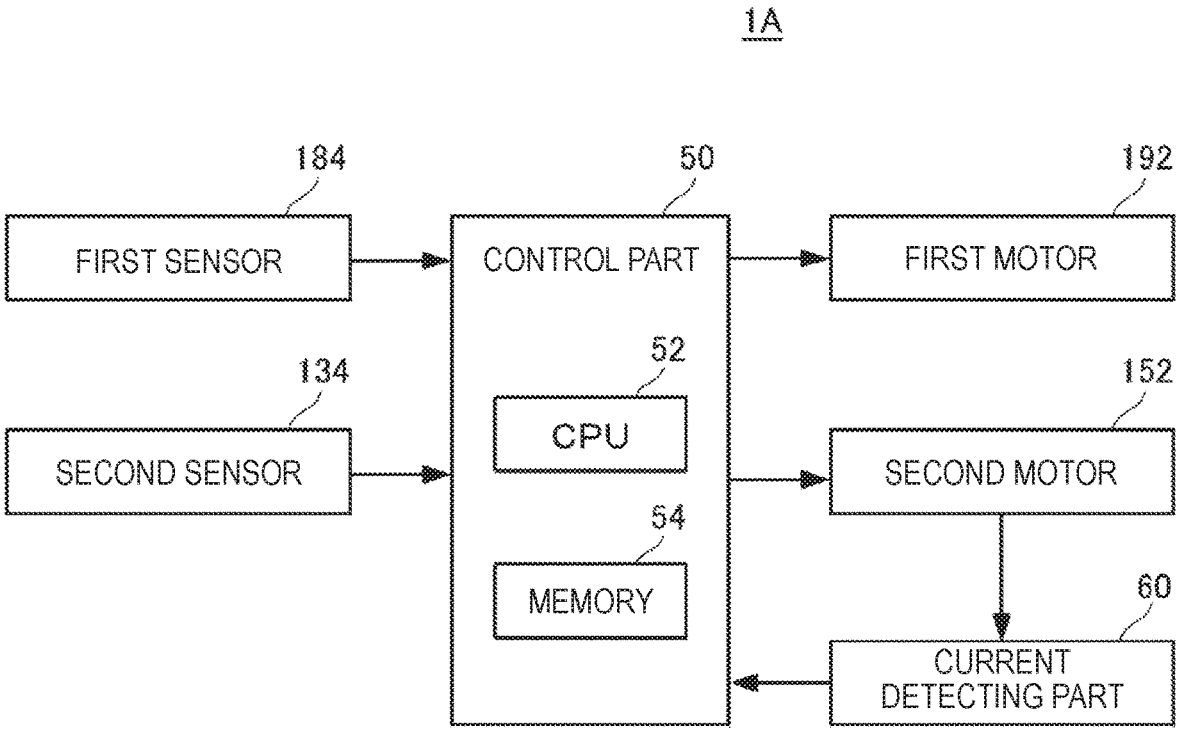
FIG. 6 is a block diagram of the staple removing device according to the first embodiment.

FIG. 1A is a front perspective view of a staple removing device 1A according to a first embodiment, and FIG. 1B is a rear perspective view of the staple removing device 1A. FIG. 2A is a perspective view of the inside of the staple removing device 1A when viewed from the right side, and FIG. 2B is a perspective view of the inside of the staple removing device 1A according to the first embodiment when viewed from the left side. FIG. 3 is a diagram illustrating a state of a staple S for binding a bundle of paper P. FIG. 4 is an exploded perspective view of a removal part 120 and a peripheral component thereof. FIG. 5 is an exploded perspective view of a paper pressing mechanism 160. FIG. 6 is a block diagram of the staple removing device 1A.

The staple removing device 1A is a device for automatically removing a staple from a bundle of paper bound by the staple, and as illustrated in FIGS. 1A to 2B, the staple removing device 1A includes: a casing 100 having an approximately rectangular parallelepiped shape; a placement part 102 on which the bundle of paper bounded with the staple including a crown part and a leg part can be placed; a paper pressing part 170 that is provided at a position facing the bundle of paper placed on the placement part 102, configured to be movable toward the bundle of paper, and presses the bundle of paper against the placement part 102 by the movement; the removal part 120 that is positioned on a side where the crown part of the bundle of paper placed on the placement part 102 is exposed, is configured to be able to be inserted between the bundle of paper and the staple, and removes the staple from the bundle of paper by the insertion; a current detecting part 60 which is an example of a load detecting part that detects an insertion load of the removal part 120 (a current value of a second motor 152) when the removal part 120 is inserted between the bundle of paper and the staple; and a control part 50 that adjusts a pressing force of the paper pressing part 170 based upon the insertion load detected by the current detecting part 60.

A cover part 104 that covers a part of the placement part 102 is provided above the placement part 102 (on a side where the bundle of paper is placed with respect to the placement part 102). A predetermined gap (a paper inserting port) 108 is formed between the cover part 104 and the placement part 102, and the bundle of paper is inserted into the gap formed therebetween. A start switch 106 that operates the staple removing device 1A is provided on an upper surface of the cover part 104. In the embodiment, a side where a housing part 200 is provided is defined as a rear side of the staple removing device 1A, and an opposite side thereof is defined as a front side of the staple removing device 1A.

The casing 100 is a box-shaped body having an approximately rectangular parallelepiped shape with an opening at the top, and the removal part 120 and the housing part 200 are provided inside.

The placement part 102 is provided to cover an opening part above the casing 100, and has a placement surface 102*a* for placing the bundle of paper. An opening part 102*b* is formed on the placement surface 102*a* so that a part of the removal part 120 can protrude.

The staple S in a state of binding the bundle of paper P will be described with reference to FIG. 3 and the like. The staple S includes a crown part Sa and a pair of leg parts Sb and Sb formed by bending opposite end parts of the crown part Sa in a longitudinal direction. Binding processing of the bundle of paper P is performed by causing the pair of leg parts Sb and Sb of the staple S to be penetrated from the paper of a lowest layer of a plurality of sheets of stacked paper toward the paper of a highest layer thereof, and by bending the penetrated leg parts Sb and Sb inward. A binding position of the staple S is, for example, a corner part and an edge part of the paper. In the embodiment, the staple S is removed from the above-described bundle of paper P.

As illustrated in FIG. 4, the removal part 120 includes: a wedge plate 122 inserted between the crown part of the staple S and the bundle of paper, a plate holder 124 formed of a flat plate having an approximately U-shaped cross section; a crown holder 126 that supports the crown part Sa of the staple S; a holder 128 that is arranged to overlap an upper surface of the plate holder 124; and a pair of racks 130 and 131 mounted on side surfaces of the plate holder 124.

As illustrated in FIG. 4, the wedge plate 122 includes: a wedge plate main body 122*a* that removes the staple S from the bundle of paper P; a mounting part 122*b* that is mounted on the plate holder 124; and a staple dropping part 122*c* for dropping the staple S removed from the bundle of paper P by the wedge plate main body 122*a* into the housing part 200.

As illustrated in FIG. 4, the plate holder 124 is formed of the flat plate having the approximately U-shaped cross section, the mounting part 122*b* is mounted on the upper surface of the plate holder 124, and the plate holder 124 is arranged above the crown holder 126 in an overlapping manner.

As illustrated in FIG. 4, the crown holder 126 is arranged below the wedge plate 122 in a state where the plate holder 124 is interposed between the wedge plate 122 and the crown holder 126, and supports the crown part Sa of the staple S removed from the bundle of paper P. The crown holder 126 includes: a groove part 126*a* for preventing contact with a pressing part 140 when the wedge plate 122 moves forward; and an opening part 126*b* for dropping the staple S removed from the bundle of paper P into the housing part 200. The opening part 126*b* of the crown holder 126 and the staple dropping part 122*c* of the wedge plate 122 to be mounted on the plate holder 124 are arranged to be at the same position in a plan view. The groove part 126*a* is cut out from a tip part of the crown holder 126 to an approximately center part thereof, and has a width slightly wider than a width of the pressing part 140. The opening part 126*b* is formed approximately at a center part of the crown holder 126 in a longitudinal direction, continuously formed on a base end side of the groove part 126*a*, and has, for example, a width wider than a length of the crown part Sa of the staple S.

A spring 125 is arranged between a lower surface on the other end side of the plate holder 124 and an upper surface on the other end side of the crown holder 126, and an elastic force of the spring 125 energizes one end (tip) side of the wedge plate 122 and one end (tip) side of the crown holder 126 in an approaching direction.

The holder 128 is formed of a flat plate having an approximately U-shaped cross section. The holder 128 includes an opening part 128*a* for exposing the wedge plate 122; and a support part 128*b* that regulates the pressing part 140 so that the pressing part 140 is positioned below one end of the wedge plate 122 when at least the removal part 120 is stopped at a standby position L1.

As illustrated in FIGS. 2B and 4, the plate-shaped rack 130 having a length approximately the same as a longitudinal direction of the plate holder 124 is arranged on a left side of the plate holder 124. The rack 130 receives a drive force of the second motor 152. A plurality of teeth that mesh with a pinion 158 which will be described later are formed on a lower surface of the rack 130.

As illustrated in FIGS. 2A and 4, a plate-shaped rack 131 having a length approximately the same as the longitudinal direction of the plate holder 124 is arranged on a right side of the plate holder 124. The rack 131 receives the drive force of the second motor 152. A plurality of teeth that mesh with a pinion 159 which will be described later are formed on a lower surface of the rack 131.

As illustrated in FIG. 4, on a left side of the rack 130, a second sensor 134 that detects a position of the removal part 120 is provided, and a flag mounting plate 132 that detects a position of the removal part 120 in a front and rear direction is provided. A first flag 132*a* that detects movement of the wedge plate 122 from the standby position L1 to a removal position L2 is provided at a rear end part of the flag mounting plate 132. A second flag 132*b* that detects arrival of the wedge plate 122 at the removal position L2 is provided at a front end part of the flag mounting plate 132. The second sensor 134 is formed of a transmission type sensor and detects the first flag 132*a* and the second flag 132*b* of the flag mounting plate 132 that moves in the front and rear direction.

A first drive shaft 136 is inserted, from a left side to a right side of the casing 100, into opening parts respectively formed in the flag mounting plate 132, the rack 130, the plate holder 124, the crown holder 126, and the rack 131.

A second drive shaft 138 is inserted, from the left side to the right side of the casing 100, into opening parts respectively formed in the flag mounting plate 132, the rack 130, the plate holder 124, and the rack 131.

As described above, the removal part 120 is formed by assembling the wedge plate 122, the plate holder 124, the crown holder 126, the holder 128, the racks 130 and 131, and the flag mounting plate 132 by the first drive shaft 136 and the second drive shaft 138, and the removal part 120 is configured to be integrally movable forward and backward.

As illustrated in FIGS. 3 and 4, the pressing part 140 that regulates the movement in the insertion direction of the bundle of paper P and the staple S is arranged on a rear side of the crown part Sa which is at the removal position L2, and is configured to be able to contact the crown part Sa pushed by the wedge plate 122. A width of the pressing part 140 is selected, for example, to have a length that can support the crown part Sa moving from the front to the rear by a pushing force of the wedge plate 122 and can be inserted into the groove part 126*a* of the crown holder 126.

A pressing holder 142 that supports the pressing part 140 is formed of a flat plate processed into an approximately U shape in a top view, and a rear end side of the pressing holder 142 is rotatably supported by a shaft 146. One end part of a tension spring 144 is mounted further rearward than the shaft 146 of the pressing holder 142. The other end part of the tension spring 144 is mounted on a frame which is not illustrated. A protruding part 142*a* that can abut on the support part 128*b* of the holder 128 is provided on an upper end part of the rear side of the pressing holder 142.

The second motor 152 is formed of, for example, a DC motor, a DC brushless motor, and the like. The second motor 152 is driven based upon an instruction from the control part which is not illustrated, thereby transmitting the drive force of the second motor 152 to the removal part 120 via speed reducing mechanisms such as gears 153, 154, and 155, and moving the removal part 120 forward or backward.

The paper pressing part 170 presses the bundle of paper P placed on the placement part 102. As illustrated in FIGS. 2A and 2B, at least a part of the paper pressing part 170 is positioned above the placement part 102 and is configured to be movable toward the placement part 102. The paper pressing part 170 is driven by a first motor 192 that drives the paper pressing part 170.

The paper pressing part 170 includes: a paper pressing plate 176 that presses the bundle of paper P placed on the placement part 102; a hold lever 172 that supports the paper pressing plate 176; and a pair of paper pressing racks 174 and 175 mounted on the hold lever 172.

The hold lever 172 is arranged on a rear side of the casing 100, and an upper part side thereof is arranged to be exposed from the placement part 102 and is covered with the cover part 104.

The paper pressing racks 174 and 175 are provided at a lower front end part of the hold lever 172. The paper pressing racks 174 and 175 are formed into an approximately fan shape and mesh with paper pressing pinions 198 and 199. The paper pressing racks 174 and 175 convert a rotation operation of the paper pressing pinions 198 and 199 into an approximately linear operation.

In order to prevent the bundle of paper P from shifting from the removal position L2 of the placement part 102 during the removal operation of the staple S, the paper pressing plate 176 presses the bundle of paper P placed on the placement part 102 by moving toward a direction of the placement surface 102*a*. The paper pressing plate 176 is mounted on the hold lever 172 to be parallel to or almost parallel to the placement part 102.

The first motor 192 is formed of, for example, a DC motor, a DC brushless motor, and the like. The first motor 192 is driven based upon an instruction from the control part which is not illustrated, thereby transmitting a drive force of the first motor 192 to the paper pressing part 170 via speed reducing mechanisms such as gears 193, 194, and 1195, and operating the paper pressing part 170.

As illustrated in FIG. 5, a flag 183 indicating a position of the paper pressing part 170 is provided between the hold lever 172 and the paper pressing rack 174. A first sensor 184 that acquires position information of the paper pressing part 170 according to information indicating presence of detection of the flag 183 is provided in a vicinity of the flag 183. The first sensor 184 is, for example, a transmission type sensor.

[Block Diagram of Staple Removing Device 1A]

FIG. 6 is a block diagram of the staple removing device 1A according to the first embodiment.

As illustrated in FIG. 6, the staple removing device 1A includes the control part 50 that controls an overall operation of the device. The first sensor 184, the second sensor 134, the first motor 192, the second motor 152, and the current detecting part 60 are respectively connected to the control part 50.

The control part 50 includes a central processing unit (CPU) 52 and a memory 54. The CPU 52 functions as a calculation processing device and controls an overall operation inside the staple removing device 1A according to various programs. The memory 54 includes, for example, a read only memory (ROM) and a random access memory (RAM). The memory 54 stores a program used by the CPU 52, and a calculation parameter. The memory 54 temporarily stores the program to be used in the execution of the CPU 52, and a parameter that appropriately changes in the execution thereof.

The first sensor 184 detects the flag 183 that operates based upon the drive of the first motor 192, and outputs the detection result to the control part 50 as position information of the paper pressing plate 176. The second sensor 134 respectively detects the first flag 132*a* and the second flag 132*b* that operate based upon the drive of the second motor 152, and outputs the detection result to the control part 50 as position information of the wedge plate 122.

The first motor 192 includes a drive circuit, is rotationally driven based upon a drive signal supplied from the control part 50, and causes the paper pressing plate 176 to move in a direction of approaching or separating from the placement part 102. The second motor 152 includes a drive circuit, is rotationally driven based upon a drive signal supplied from the control part 50, and causes the wedge plate 122 to move from the front to the rear and from the rear to the front.

The current detecting part 60 detects a value of a current flowing through the second motor 152, and outputs the detection result to the control part 50 as an insertion load of the wedge plate 122.

[Operation Example of Staple Removing Device 1A]

Next, an operation of the staple removing device 1A when the staple S is removed from the bundle of paper P will be described.

FIGS. 7A to 7G are side views illustrating an example of the operation of the staple removing device 1A when the staple S is removed from the bundle of paper P.

Figure 7A:
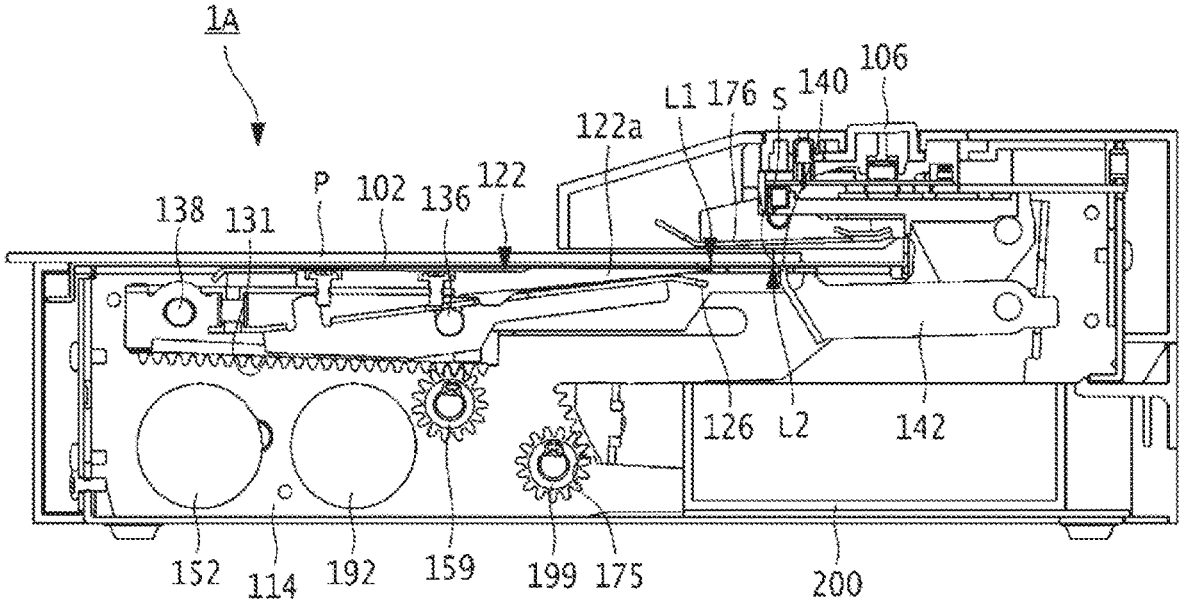
FIG. 7A is a side view illustrating an operation of the staple removing device when the staple is removed from the bundle of paper according to the first embodiment.

As illustrated in FIG. 7A, when the staple S is removed from the bundle of paper P, first, the bundle of paper P bound by the staple S is placed on the placement part 102 after a binding part is inserted into the paper inserting port 108. Here, a user aligns the bundle of paper P with a mark indicating the removal position L2 provided on the placement part 102, and places the crown part Sa side of the staple S toward the placement part.

Figure 7B:
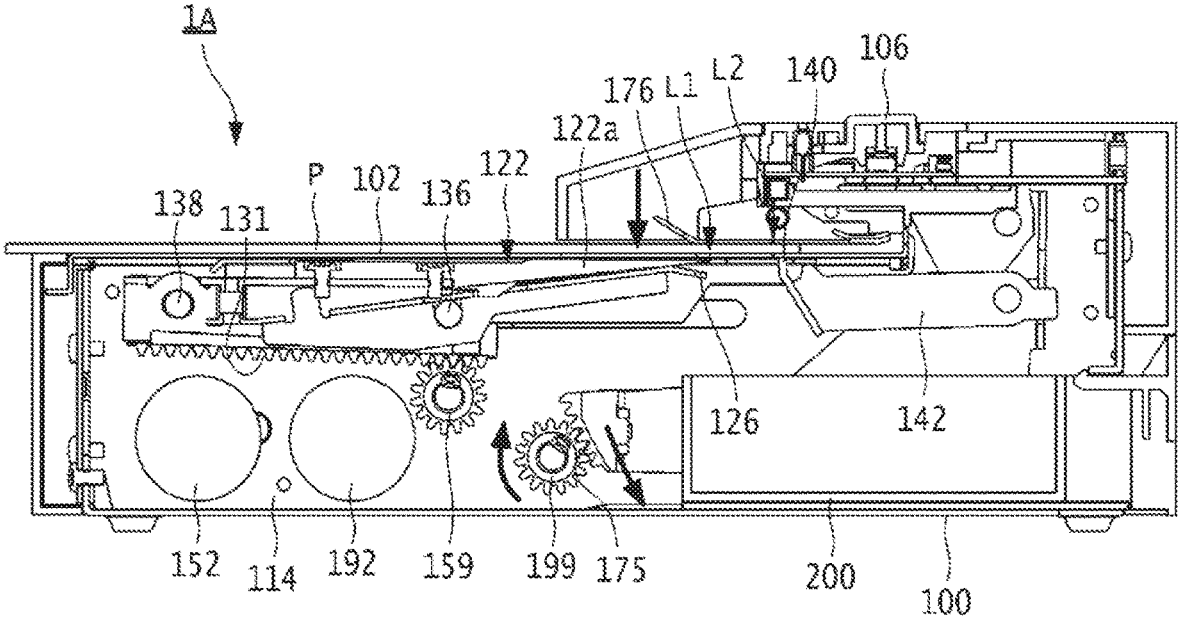
FIG. 7B is a side view illustrating the operation of the staple removing device when the staple is removed from the bundle of paper according to the first embodiment.

Next, when the user presses the start switch 106 of the staple removing device 1A, the first motor 192 is driven, and as illustrated in FIG. 7B, the paper pressing plate 176 moves (descends) in a direction of approaching the placement part 102. When the paper pressing plate 176 moves to a predetermined position, the bundle of paper P is pressed by the paper pressing plate 176 with a constant pressing force.

Continuously, after a lapse of a predetermined time from the start of driving the first motor 192, the second motor 152 is driven, and the pinion 159 rotates clockwise. When the pinion 159 rotates, the removal part 120 including the rack 131 and the wedge plate 122 moves forward (moves from the front to the rear with respect to the casing 100).

Figure 7C:
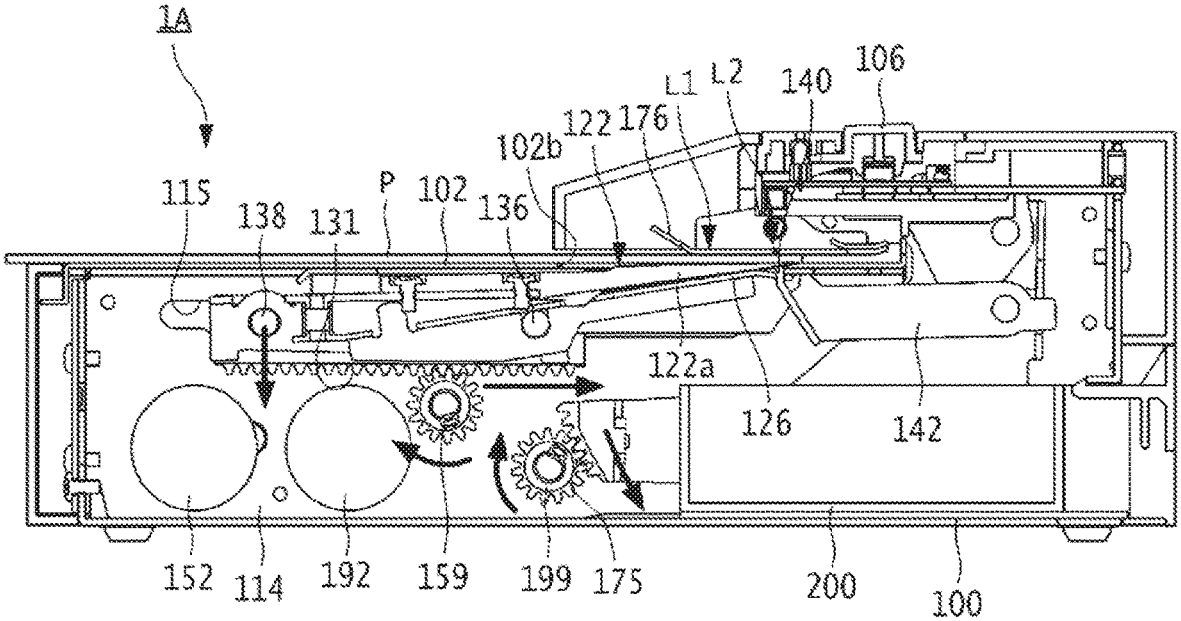
FIG. 7C is a side view illustrating the operation of the staple removing device when the staple is removed from the bundle of paper according to the first embodiment.

When the removal part 120 moves forward, the second drive shaft 138 of the removal part 120 moves along a guide groove which is not illustrated, such that as illustrated in FIG. 7C, a tip of the wedge plate 122 protrudes from the placement surface 102*a* through the opening part 102*b* of the placement part 102. The wedge plate 122 moves forward while an upper surface thereof is in contact with a back surface of the paper of the lowest layer of the bundle of paper P.

When the tip of the wedge plate 122 moves to the removal position L2, as illustrated in FIG. 7C, the tip thereof is inserted between the crown part Sa and the bundle of paper P. When the wedge plate 122 further moves forward, the protruding part 142*a* of the pressing holder 142 is disengaged from the support part 128*b* of the holder 128. Accordingly, the pressing part 140 rises by the energization of the tension spring 144, abuts on the crown part Sa of the bundle of paper P that moves from the front to the rear by a pushing force of the wedge plate 122, and regulates the forward movement of the staple S.

Figure 7D:
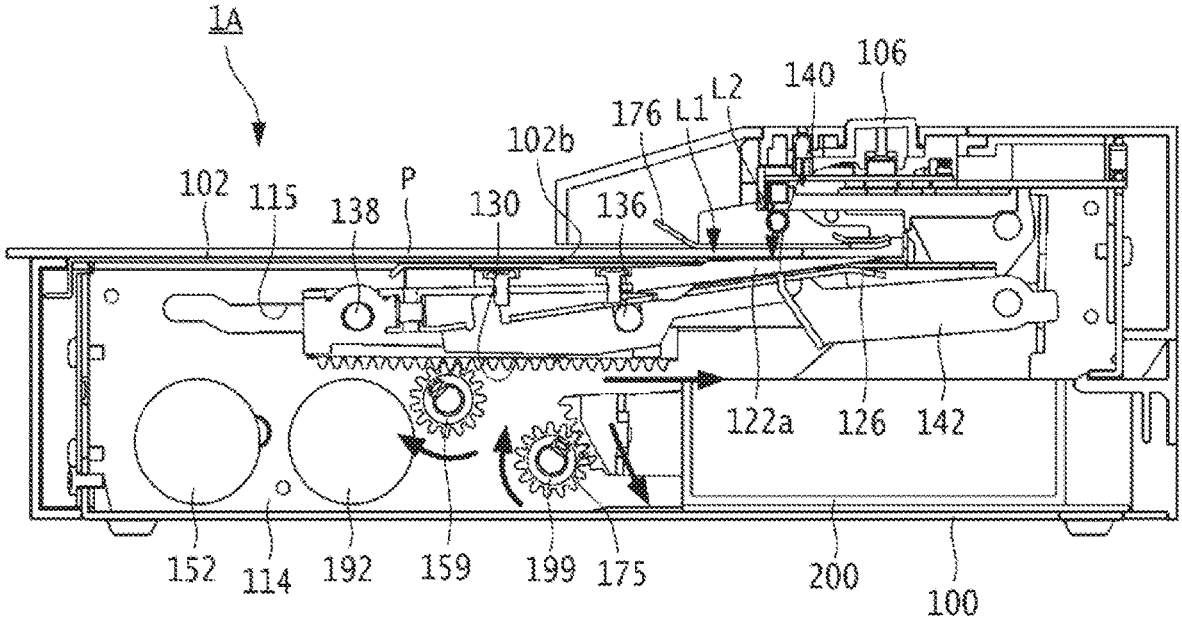
FIG. 7D is a side view illustrating the operation of the staple removing device when the staple is removed from the bundle of paper according to the first embodiment.
Figure 7E:
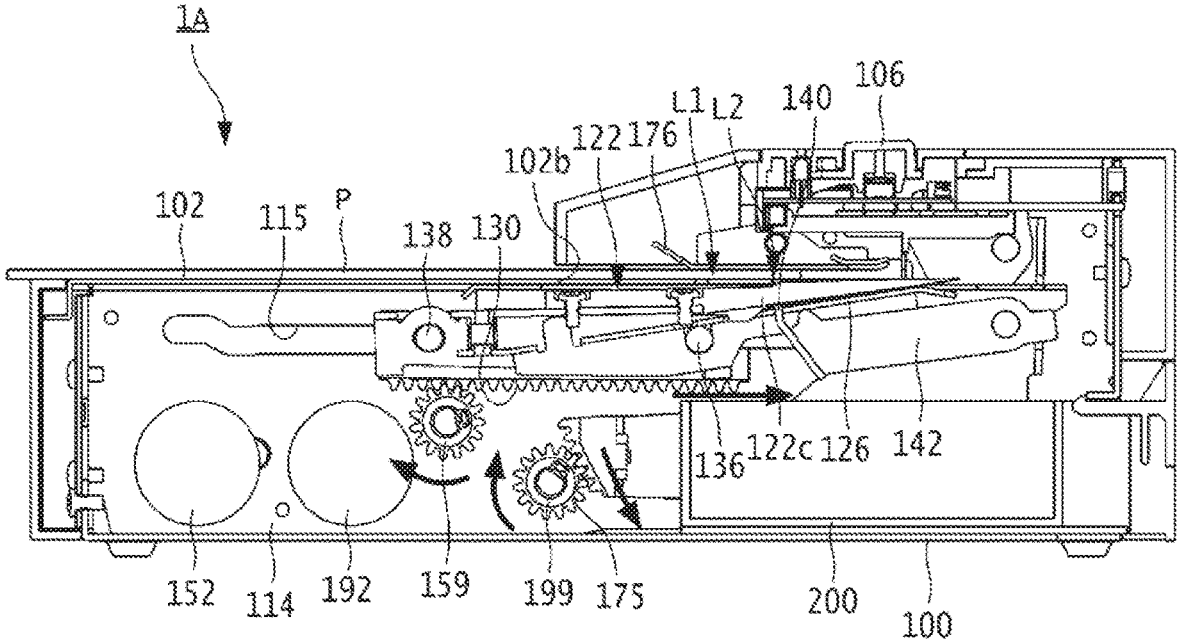
FIG. 7E is a side view illustrating the operation of the staple removing device when the staple is removed from the bundle of paper according to the first embodiment.

When a tip side of the wedge plate 122 passes through the removal position L2 and further moves forward, as illustrated in FIG. 7D, a thickness of the wedge plate 122 inserted between the bundle of paper P and the crown part Sa at the removal position L2 in a side view becomes thicker, and the staple is gradually removed from the bundle of paper P. The pressing part 140 follows a thickness direction of the wedge plate 122 and descends in a state of abutting on the wedge plate 122 and the crown part Sa by the extension of the tension spring 144. As a result, the crown part Sa is pushed by the wedge plate 122 in a direction of separating from the bundle of paper P, and the leg parts Sb and Sb of the staple S that are bent inward become in a state of being raised to be approximately orthogonal to a paper surface of the bundle of paper P. As illustrated in FIG. 7E, when the thickness of the wedge plate 122 at the removal position L2 in the side view becomes further thicker, the leg parts Sb and Sb of the staple S are pulled out from the bundle of paper P. However, since the leg parts Sb and Sb become a state of being caught on a side surface of the wedge plate 122 by spring-back of the staple S, the staple S does not fall at this stage.

Figure 7F:
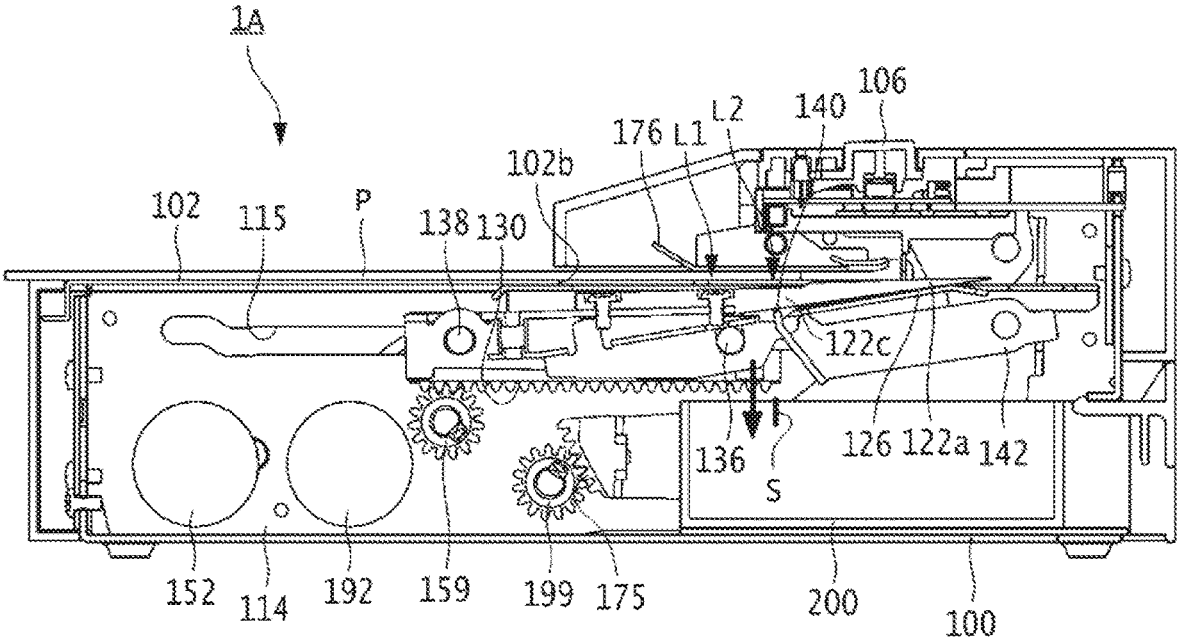
FIG. 7F is a side view illustrating the operation of the staple removing device when the staple is removed from the bundle of paper according to the first embodiment.

As illustrated in FIG. 7F, when the wedge plate 122 moves to an end position of a movement range, the staple dropping part 122*c* is positioned at the removal position L2, and the removed staple is also positioned at the staple dropping part 122*c*. As a result, the leg parts Sb and Sb of the staple S are separated from the side surface of the wedge plate 122, and the staple S falls into the housing part 200.

Figure 7G:
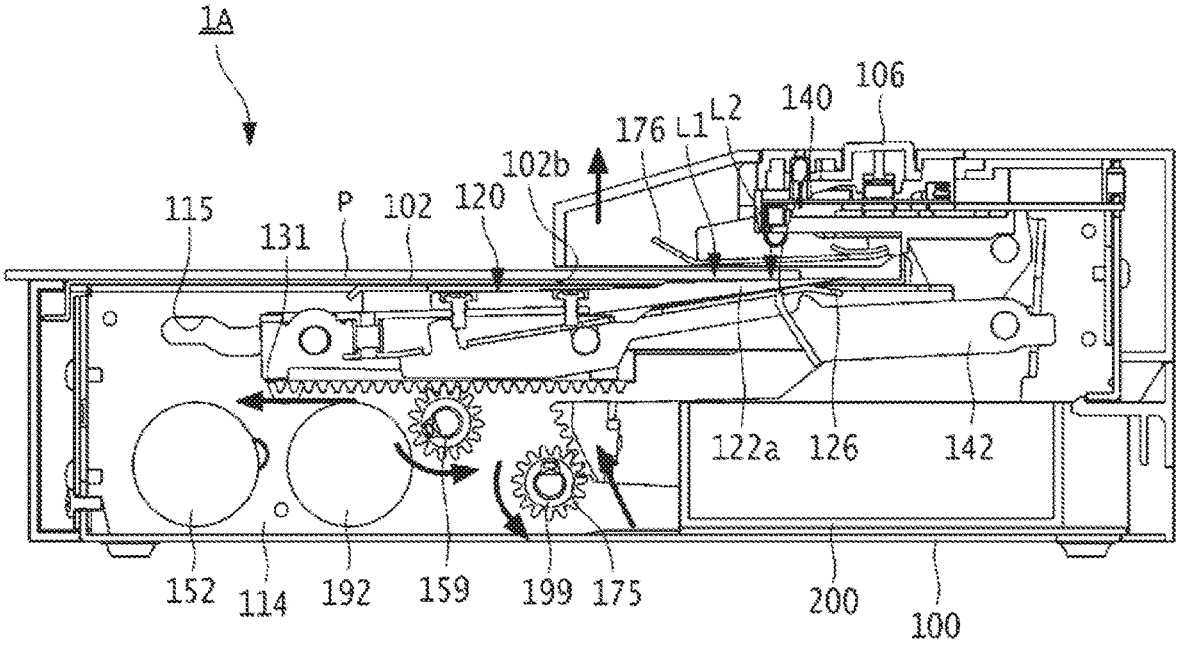
FIG. 7G is a side view illustrating the operation of the staple removing device when the staple is removed from the bundle of paper according to the first embodiment.

As illustrated in FIG. 7G, when the removal of the staple S from the bundle of paper P is completed, the second motor 152 rotates in a reverse direction, and the pinion 159 also rotates counterclockwise in the reverse direction. When the pinion 159 rotates in the reverse direction, the removal part 120 moves backward along the placement part 102 (moves from the rear to the front with respect to the casing 100), and the removal part 120 returns from the removal position L2 to the standby position L1. The first motor 192 is driven with the reverse rotation after a predetermined time elapses from the time of the reverse rotation of the second motor 152. Accordingly, the paper pressing pinion 199 rotates counterclockwise, whereby the paper pressing rack 175 moves approximately upward. When the paper pressing rack 175 moves upward, the paper pressing plate 176 moves in the direction of separating from the placement part 102 via the hold lever 172 and returns to the standby position.

[Example of Controlling Pressing Force of Paper Pressing Plate 176]

Figure 8:
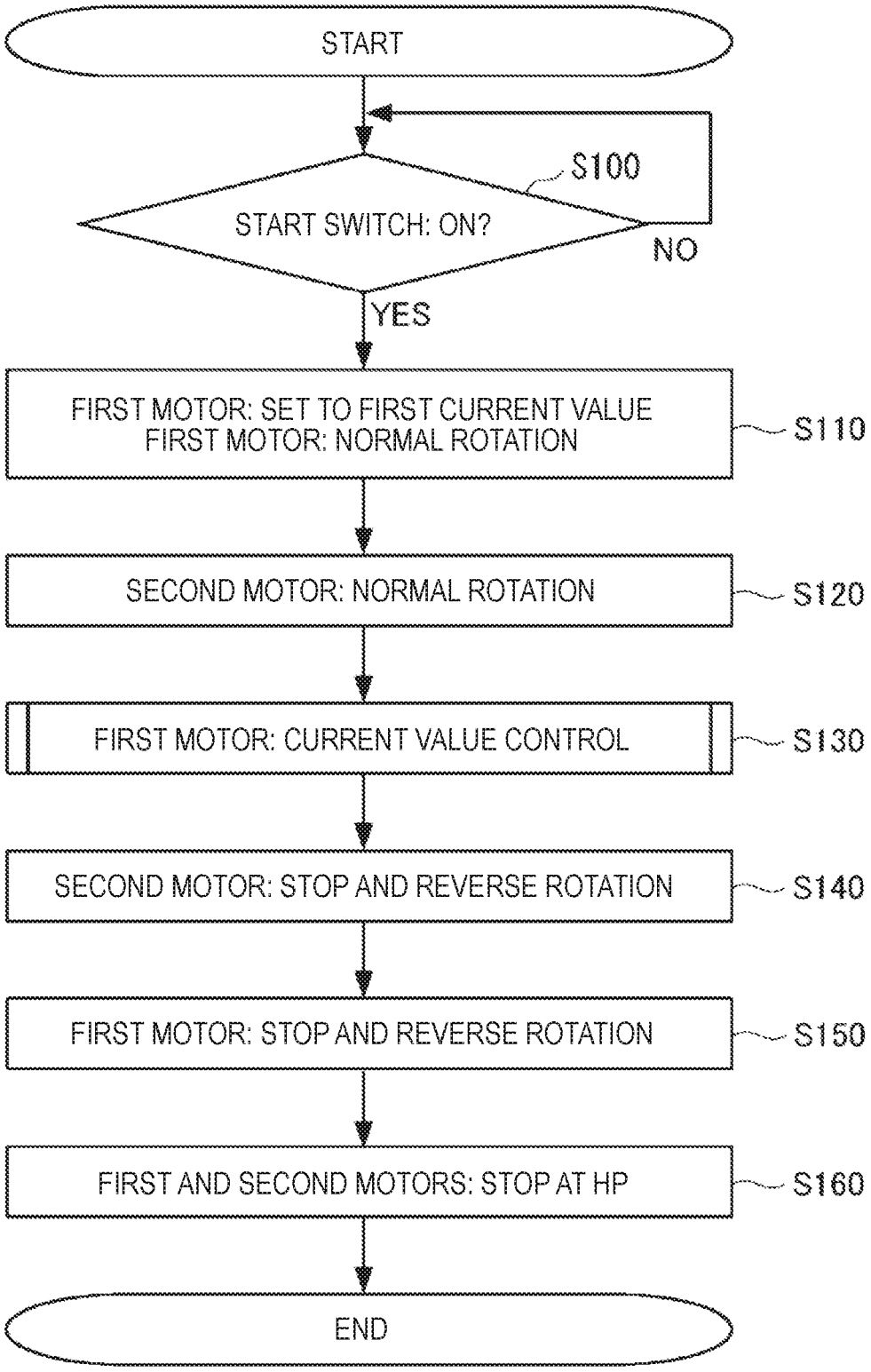
FIG. 8 is a flowchart illustrating an operation of a staple removing device 1A when a pressing force of a paper pressing plate is adjusted based upon a current value of a second motor according to the first embodiment.

FIG. 8 is a flowchart illustrating an example of an operation of the staple removing device 1A when the pressing force of the paper pressing plate 176 is adjusted based upon the current value of the second motor 152 according to the first embodiment. The operation illustrated in FIG. 8 is mainly realized by allowing the CPU 52 of the control part 50 to execute the program stored in the memory 54. It is assumed that the bundle of paper P bound by the staple S is placed on the placement part 102.

In step S100, it is determined whether the start switch 106 is turned on by a user. When the start switch 106 is not turned on, an input of turning on of the start switch 106 is continuously monitored. On the other hand, when the start switch 106 is turned on, the processing proceeds to step S110.

In step S110, a first current value is set as a current value of the first motor 192, and the first motor 192 is normally rotated with a first value (for example, a pressing force when the current value of the first motor 192 is 0.5 A). As a result, the paper pressing plate 176 starts to move (descend) from a home position in a direction of approaching the bundle of paper P placed on the placement part 102.

In step S120, the second motor 152 is normally rotated with a predetermined current value. As a result, the wedge plate 122, which is the removal part 120, starts the forward movement of the home position.

In step S130, the current value of the first motor 192 is limited based upon the current value of the second motor 152 detected by the current detecting part 60, and the pressing force of the paper pressing plate 176 against the bundle of paper P is adjusted. The details of a subroutine of step S130 will be described later.

In step S140, when the second sensor 134 detects the second flag 134*b* (refer to FIG. 4), the second motor 152 is stopped. Here, the wedge plate 122 moves to the end of the movement range in the guide groove which is not illustrated, and the staple S is in a state of being removed from the bundle of paper P. Continuously, after a lapse of a predetermined time, the second motor 152 is reversely rotated. As a result, the wedge plate 122 moves backward and moves toward the home position.

In step S150, the first motor 192 is stopped after a lapse of a predetermined time from the start of the backward movement of the wedge plate 122. Here, the bundle of paper P placed on the placement part 102 is in a state of being pressed by the paper pressing plate 176 with a predetermined pressing force. Continuously, after the lapse of the predetermined time, the first motor 192 rotates in the reverse direction. As a result, the paper pressing plate 176 moves in the direction (upward) of separating from the bundle of paper P.

In step S160, when the first flag 132*a* (refer to FIG. 4) is detected by the second sensor 134, the wedge plate 122 is stopped at the home position by stopping the second motor 152. In the same manner, when the flag 183 is detected by the first sensor 184, the paper pressing plate 176 is stopped at the home position by stopping the first motor 192.

Figure 9:
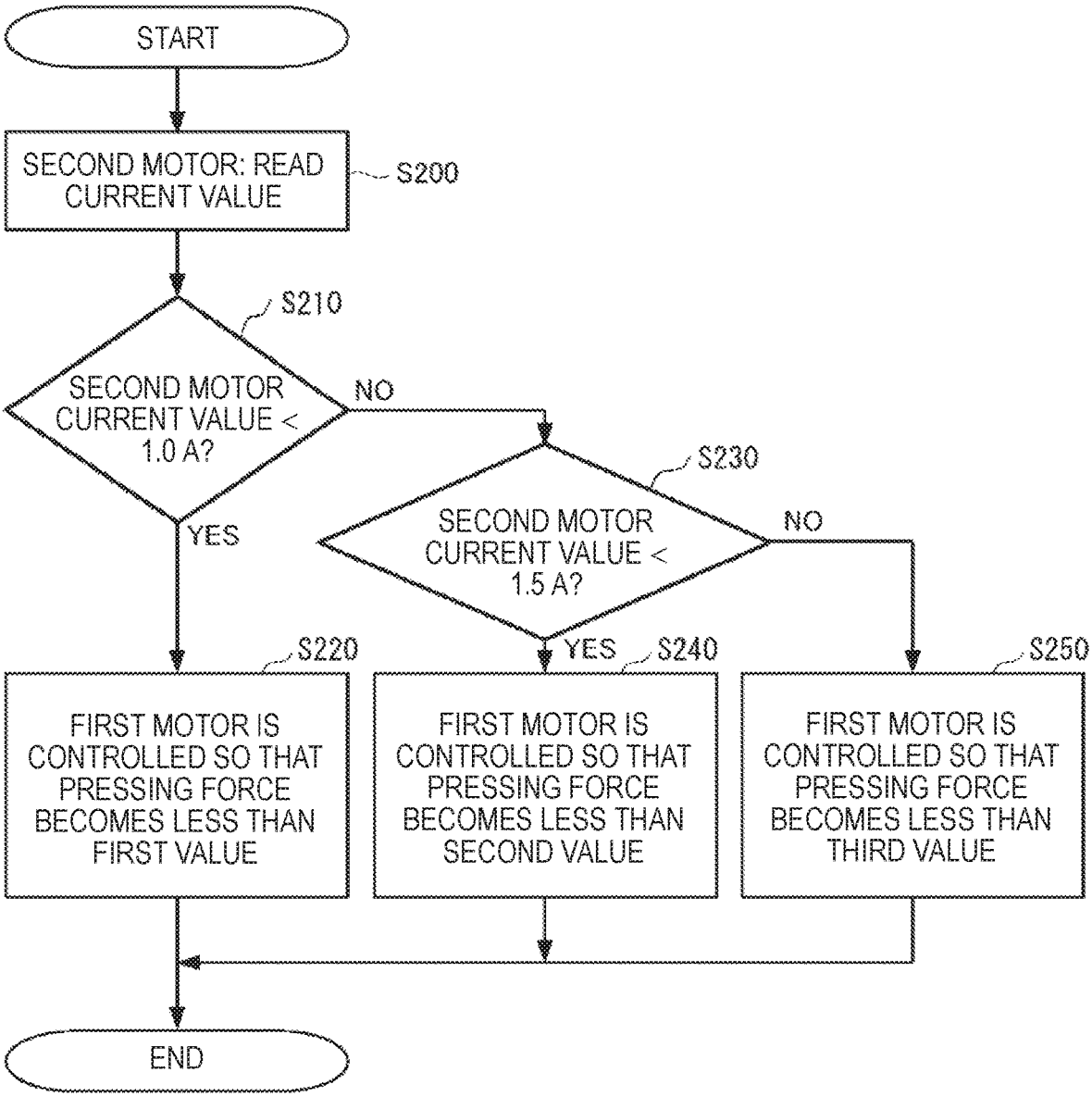
FIG. 9 is a subroutine of step S130 illustrated in FIG. 8 according to the first embodiment.

FIG. 9 is a subroutine of step S130 illustrated in FIG. 8 according to the first embodiment, and is a flowchart illustrating a control operation of the first motor 192 by the control part 50.

In step S200, a current value flowing through the second motor 152 detected by the current detecting part 60 is acquired (read).

In step S210, it is determined whether the acquired current value of the second motor 152 is less than 1.0 A (a first threshold value). In a case where the current value of the second motor 152 is less than 1.0 A, for example, it indicates that the thin bundle of paper P is bound with the staple S having a small diameter, and a load when the staple S is removed from the bundle of paper P is small. That is, it indicates the pressing force of the paper pressing plate 176 against the bundle of paper P is not required so much. When the current value of the second motor 152 is less than 1.0 A, the processing proceeds to step S220, whereas when the current value of the second motor 152 is equal to or greater than 1.0 A, the processing proceeds to step S230.

In step S220, the current value of the first motor 192 is controlled so that the pressing force of the paper pressing plate 176 becomes less than the first value. In the embodiment, the pressing force of the paper pressing plate 176 is adjusted to be less than the first value by limiting the current value of the first motor to 0.5 A or less. As a result, the paper pressing plate 176 can press the bundle of paper P placed on the placement part 102 with a weak pressing force. When step S220 is completed, the processing proceeds to step S140 illustrated in FIG. 8.

In step S230, it is determined whether the current value of the second motor 152 is less than 1.5 A. When the current value of the second motor 152 is less than 1.5 A, the processing proceeds to step S240, whereas when the current value of the second motor 152 is equal to or greater than 1.5 A, the processing proceeds to step S240.

In step S240, the current value of the first motor 192 is controlled so that the pressing force of the first motor 192 becomes less than a second value. In the embodiment, the pressing force of the paper pressing plate 176 against the bundle of paper P is adjusted to be less than the second value by limiting the current value of the first motor to 1.0 A or less. As a result, the paper pressing plate 176 can press the bundle of paper P placed on the placement part 102 with an intermediate (standard) pressing force. When step S240 is completed, the processing proceeds to step S140 illustrated in FIG. 8.

On the other hand, in step S250, the current value of the first motor 192 is limited to be greater than 1.0 A and equal to or less than 1.5 Aso that the pressing force of the first motor 192 becomes less than a third value, whereby the pressing force of the paper pressing plate 176 against the bundle of paper P is adjusted to be less than the third value. As a result, the paper pressing plate 176 can press the bundle of paper P placed on the placement part 102 with a strong pressing force. When step S250 is completed, the processing proceeds to step S140 illustrated in FIG. 8.

As described above, according to the first embodiment, the pressing force of the paper pressing plate 176 against the bundle of paper P is adjusted by controlling the current value of the first motor 192 based upon the current value (load) of the second motor 152 when the wedge plate 122 is inserted between the bundle of paper P and the crown part Sa. As a result, the bundle of paper P can be prevented from being pressed with a maximum (constant) pressing force at all times regardless of a type of the bundle of paper P as in a related art, and the bundle of paper P can be pressed with an optimum pressing force by the paper pressing plate 176 according to the type of the bundle of paper P. For example, when the bundle of paper P is thin, the bundle of paper P can be pressed with the weak pressing force, and when the bundle of paper P is thick, the bundle of paper P can be pressed with the strong pressing force, such that it is possible to prevent wasteful current consumption as compared with a case in which the bundle of paper P is always pressed with the constant pressing force. It is possible to prevent damage to the bundle of paper P caused by an excessive pressing force of the paper pressing plate 176 against the bundle of paper P.

In the first embodiment, while 0.5 A, 1.0 A, and 1.5 A are used as examples of the threshold value of the current value of the second motor, the present disclosure is not limited thereto. While the control of the current value of the first motor 192 based upon the current value of the second motor 152 is divided into three patterns (step S220, S240, and S250) as an example, the present disclosure is not limited thereto.

Second Embodiment

In a staple removing device 1B of a second embodiment, a method of adjusting the current value of the first motor 192 is different from that of the first embodiment. Components substantially having the same function as those of the staple removing device 1A of the first embodiment will be denoted by the same reference signs, and the duplicate description thereof will be omitted or simplified.

Figure 10:
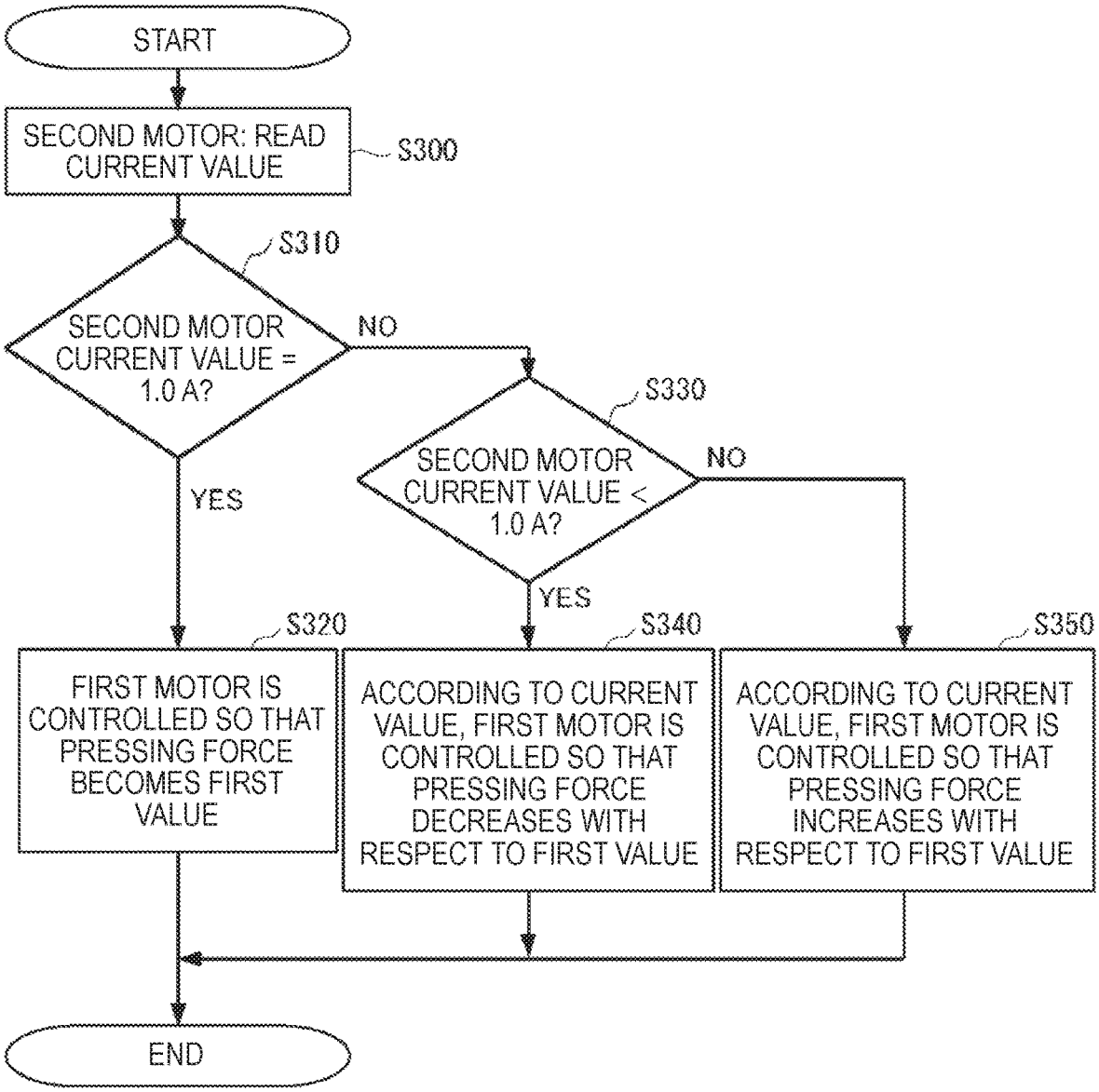
FIG. 10 is a subroutine of step S130 illustrated in FIG. 8 according to a second embodiment.

FIG. 10 is a subroutine of step S130 illustrated in FIG. 8 according to the second embodiment, and is a flowchart illustrating a control operation of the first motor 192 by the control part 50.

In step S300, a current value flowing through the second motor 152 detected by the current detecting part 60 is acquired.

In step S310, it is determined whether the current value of the second motor 152 acquired from the current detecting part 60 is the same as 1.0 A (the first threshold value). When the current value of the second motor 152 is 1.0 A, the processing proceeds to step S320, whereas when the current value of the second motor 152 is not 1.0 A, the processing proceeds to step S330.

In step S320, based upon the current value of the second motor 152 detected by the current detecting part 60, the current value of the first motor 192 is controlled so that the pressing force of the paper pressing plate 176 becomes the first value (for example, the pressing force when the current value of the first motor 192 is 0.5 A).

On the other hand, in step S330, it is determined whether the current value of the second motor 152 acquired from the current detecting part 60 is less than 1.0 A which is a threshold value set in advance. When the current value of the second motor 152 is less than 1.0 A, the processing proceeds to step S340, whereas when the current value of the second motor 152 exceeds 1.0 A, the processing proceeds to step S350.

In step S340, based upon the current value of the second motor 152 detected by the current detecting part 60, the first motor 192 is controlled so that the pressing force of the paper pressing plate 176 continuously or intermittently decreases with respect to the first value as the current value of the second motor 152 moves away from 1.0 A.

In step S350, based upon the current value of the second motor 152 detected by the current detecting part 60, the first motor 192 is controlled so that the pressing force of the paper pressing plate 176 increases continuously or intermittently with respect to the first value as the current value of the second motor 152 moves away from 1.0 A.

As described above, according to the second embodiment, in the same manner as that of the first embodiment, since the pressing force of the paper pressing plate 176 against the bundle of paper P is adjusted based upon the current value (load) of the second motor 152 when the wedge plate 122 is inserted between the bundle of paper P and the crown part Sa, the bundle of paper P can be pressed with the optimum pressing force according to the type of the bundle of paper P.

In the second embodiment, while 1.0 A is used as an example of the threshold value of the current value of the second motor, the present disclosure is not limited thereto. While the control of the current value of the first motor 192 based upon the current value of the second motor 152 is divided into three patterns as an example, the present disclosure is not limited thereto.

Third Embodiment

A staple removing device 1C of a third embodiment is different from the staple removing device 1A of the first embodiment in that the pressing force of the paper pressing plate 176 is adjusted based upon an encoder signal (a thickness of the bundle of paper P) from the first sensor 184. Components substantially having the same function as those of the staple removing device 1A of the first embodiment will be denoted by the same reference signs, and the duplicate description thereof will be omitted or simplified.

[Structure Example of Staple Removing Device 1C]

Figure 11:
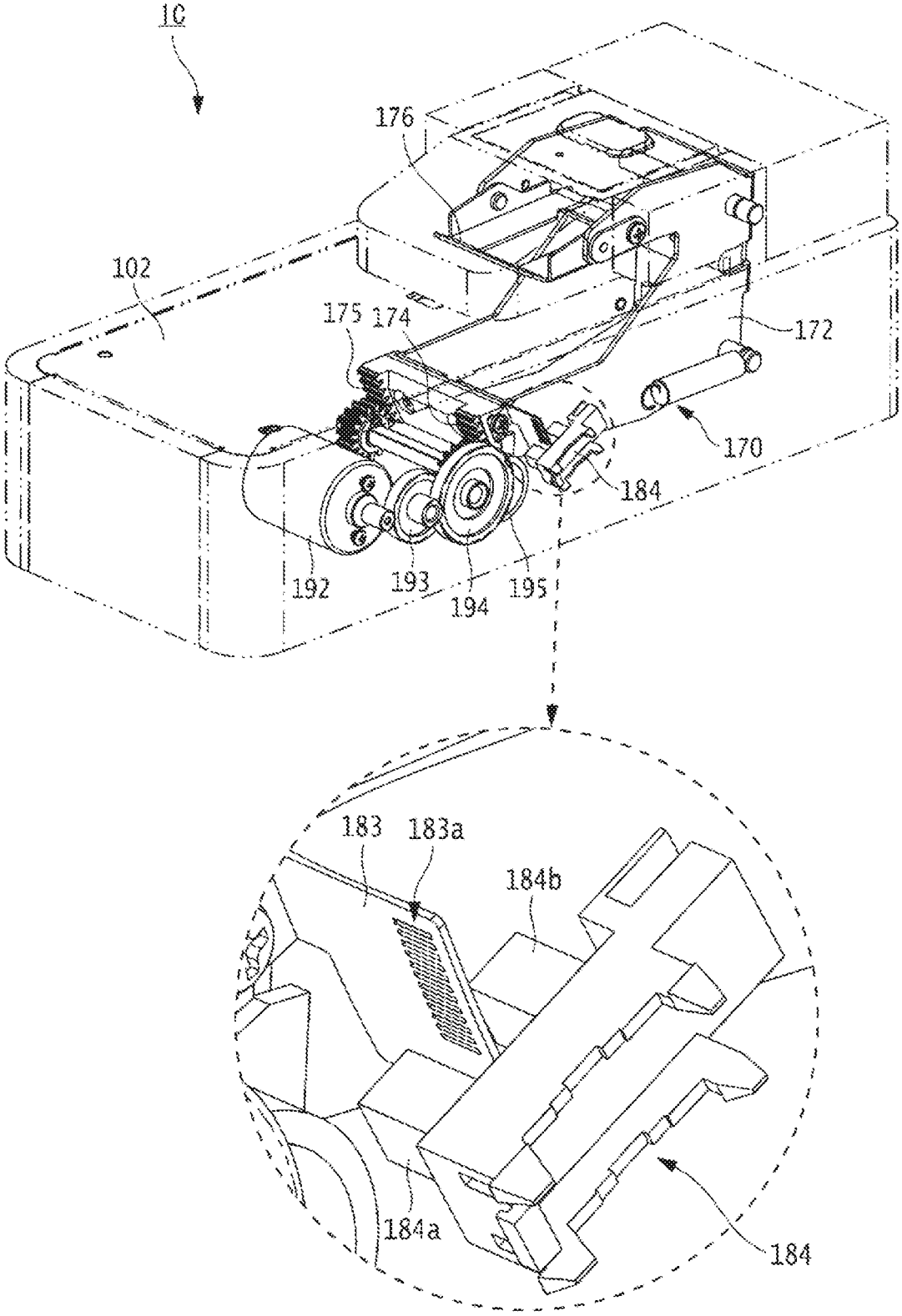
FIG. 11 is a left front perspective view of the inside of a staple removing device according to a third embodiment.
Figure 12:
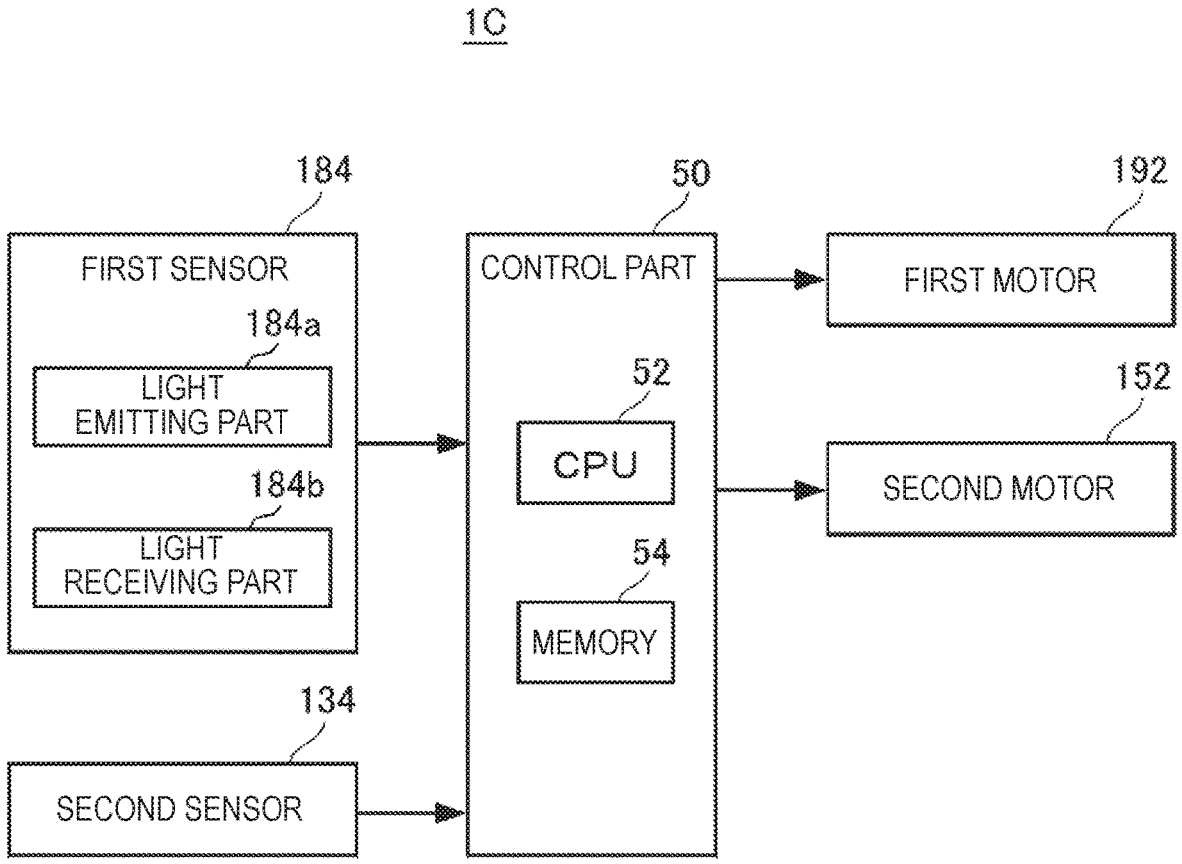
FIG. 12 is a block diagram of the staple removing device according to the third embodiment.

FIG. 11 is a perspective view of the paper pressing mechanism 160 according to the third embodiment. FIG. 12 is a block diagram of the staple removing device 1C according to the third embodiment.

In addition to the placement part 102, the paper pressing part 170, the removal part 120, and the control part 50, the staple removing device 1C includes a plurality of slits 183*a* and the first sensor 184, which are an example of a thickness detecting part that detects the thickness of the bundle of paper P placed on the placement part 102.

As illustrated in FIG. 11, the plurality of slits 183*a* are openings that penetrate the flag 183 in a thickness direction, and are formed at a predetermined gap along an approximately pressing direction of the paper pressing plate 176. The first sensor 184 includes a light emitting part 184*a* and a light receiving part 184*b*, and the light emitting part 184*a* and the light receiving part 184*b* are arranged in a state where the flag 183 is interposed therebetween. As illustrated in FIG. 12, the light receiving part 184*b* of the first sensor 184 generates a pulse-shaped encoder signal according to ON and OFF of light passing through the slit 183*a* from the light emitting part 184*a*, and outputs the generated encoder signal to the control part 50.

The control part 50 determines the thickness of the bundle of paper P placed on the placement part 102 based upon the encoder signal outputted from the first sensor 184, and adjusts the pressing force of the paper pressing part 170 according to the thickness of the bundle of paper P obtained by the determination result. For example, when the number of pulses of the encoder signal is large, the control part 50 determines that the bundle of paper P is thin because an amount of movement of the paper pressing plate 176 is large. When the number of pulses of the encoder signal is small, the control part 50 determines that the bundle of paper P is thick because the amount of movement of the paper pressing plate 176 is small.

[Example of Controlling Pressing Force of Paper Pressing Plate 176]

Figure 13:
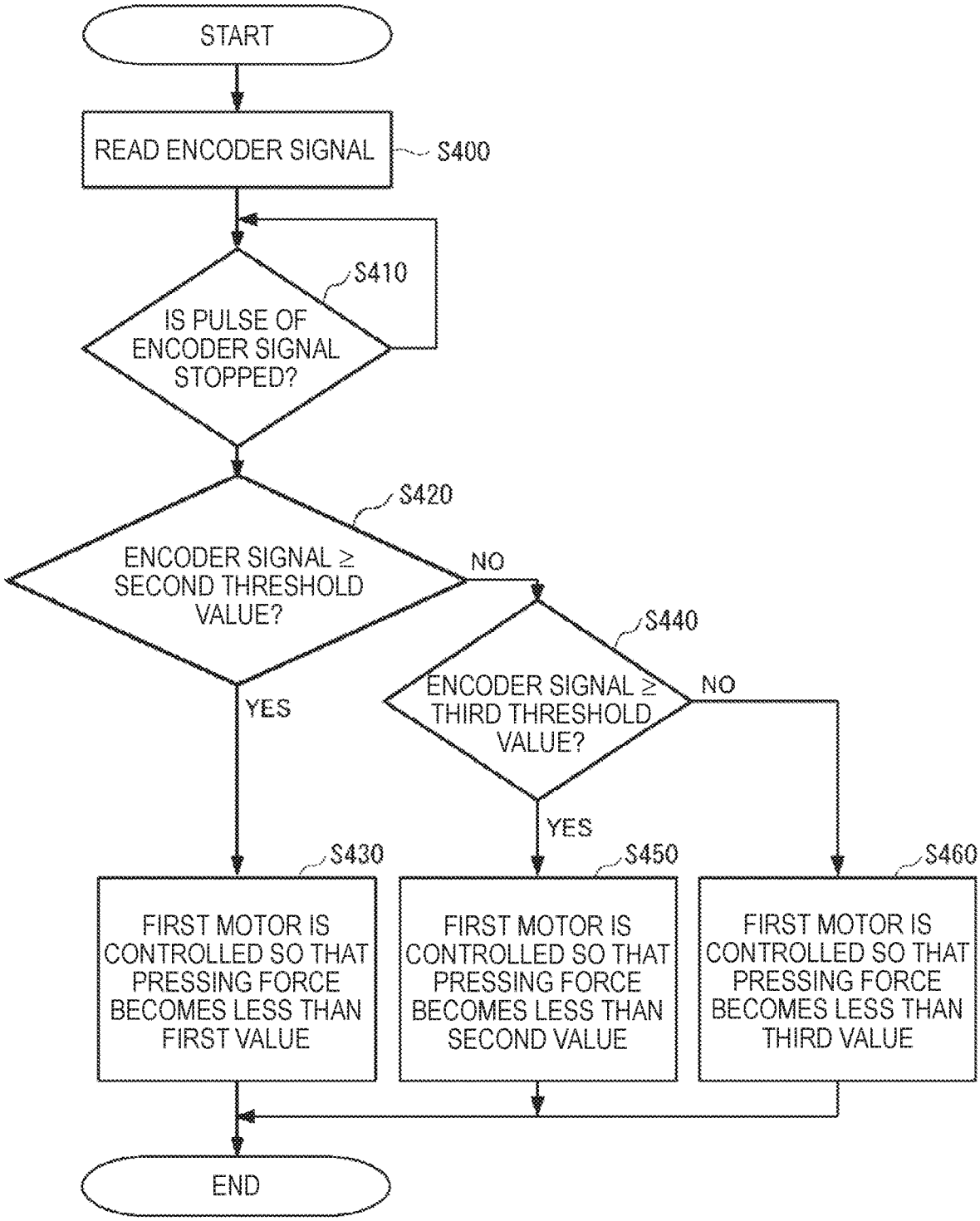
FIG. 13 is a subroutine of step S130 illustrated in FIG. 8 according to the third embodiment.

FIG. 13 is a subroutine of step S130 illustrated in FIG. 8 according to the third embodiment, and is a flowchart illustrating a control operation of the first motor 192 by the control part 50.

In step S400, the encoder signal from the first sensor 184 is acquired.

In step S410, it is determined whether an output of the encoder signal from the first sensor 184 is stopped. That is, it is determined whether the paper pressing plate 176 stops in a state of pressing an uppermost surface of the bundle of paper P. When it is determined that the output of the encoder signal from the first sensor 184 is not stopped, the output of the encoder signal is continuously monitored. On the other hand, when it is determined that the output of the encoder signal from the first sensor 184 is stopped, the processing proceeds to step S420.

In step S420, the control part 50 determines whether the number of pulses of the encoder signal acquired from the first sensor 184 is equal to or greater than 8 pulses (a second threshold value). That is, it is determined whether the number of sheets of the bundle of paper P is small and the bundle of paper P is thin. When the number of pulses of the encoder signal acquired from the first sensor 184 is equal to or greater than 8 pulses, the processing proceeds to step S430, whereas when the number of pulses of the encoder signal acquired from the first sensor 184 is less than 8 pulses, the processing proceeds to step S440.

In step S430, the current value of the first motor 192 is controlled so that the pressing force of the paper pressing plate 176 becomes less than the first value. In the embodiment, the pressing force of the paper pressing plate 176 against the bundle of paper P is adjusted by limiting the current value of the first motor 192 to 0.5 A or less. As a result, the paper pressing plate 176 can press the bundle of paper P placed on the placement part 102 with a weak pressing force. When step S430 is completed, the processing proceeds to step S140 illustrated in FIG. 8.

On the other hand, in step S440, it is determined whether the number of pulses of the encoder signal acquired from the first sensor 184 is equal to or greater than 4 pulses. That is, it is determined whether the number of sheets of the bundle of paper P is large and the bundle of paper P is thick. When the number of pulses of the encoder signal acquired from the first sensor 184 is equal to or greater than 4 pulses (a third threshold value), for example, it is determined that the bundle of paper P has an intermediate thickness, and the processing proceeds to step S450, whereas when the number of pulses of the encoder signal is less than 4 pulses, for example, it is determined that the bundle of paper P is thick, and the processing proceeds to step S460.

In step S450, the current value of the first motor 192 is controlled so that the pressing force of the paper pressing plate 176 becomes less than the second value. In the embodiment, the pressing force of the paper pressing plate 176 against the bundle of paper P is adjusted to be less than the second value by limiting the current value of the first motor 192 to be greater than 0.5 A and less than 1.0 A. As a result, the paper pressing plate 176 can press the bundle of paper P placed on the placement part 102 with an intermediate (standard) pressing force. When step S450 is completed, the processing proceeds to step S140 illustrated in FIG. 8.

In step S460, the current value of the first motor 192 is limited to be greater than 1.0 A and equal to or less than 1.5 A so that the pressing force of the paper pressing plate 176 becomes less than the third value, whereby the pressing force of the paper pressing plate 176 against the bundle of the paper P is adjusted to be less than the third value. As a result, the paper pressing plate 176 can press the bundle of paper P placed on the placement part 102 with a strong pressing force. When step S460 is completed, the processing proceeds to step S140 illustrated in FIG. 8.

In the third embodiment, while 4 and 8 pulses are respectively used as an example of the threshold value, the present disclosure is not limited thereto. While the control of the current value of the first motor 192 based upon the current value of the second motor 152 is divided into three patterns, the present disclosure is not limited thereto. In the third embodiment, the control of the first motor 192 by the control part 50 illustrated in FIG. 10 can also be applied. For example, when the thickness of the bundle of paper P is a predetermined threshold value, the pressing force is set to the first value, when the thickness of the bundle of paper P exceeds the predetermined threshold value, the pressing force continuously or intermittently increases with respect to the first value as the thickness of the bundle of paper P moves away from the predetermined threshold value, whereas when the thickness of the bundle of paper P is less than the predetermined threshold value, the pressing force continuously or intermittently decreases with respect to the first value as the thickness of the bundle of paper P moves away from the predetermined threshold value.

Fourth Embodiment

A staple removing device 1D of a fourth embodiment is different from the staple removing device 1A of the first embodiment in that the current value of the first motor 192 is adjusted based upon a standby time set in advance. Components substantially having the same function as those of the staple removing device 1A of the first embodiment will be denoted by the same reference signs, and the duplicate description thereof will be omitted or simplified.

Figure 14:
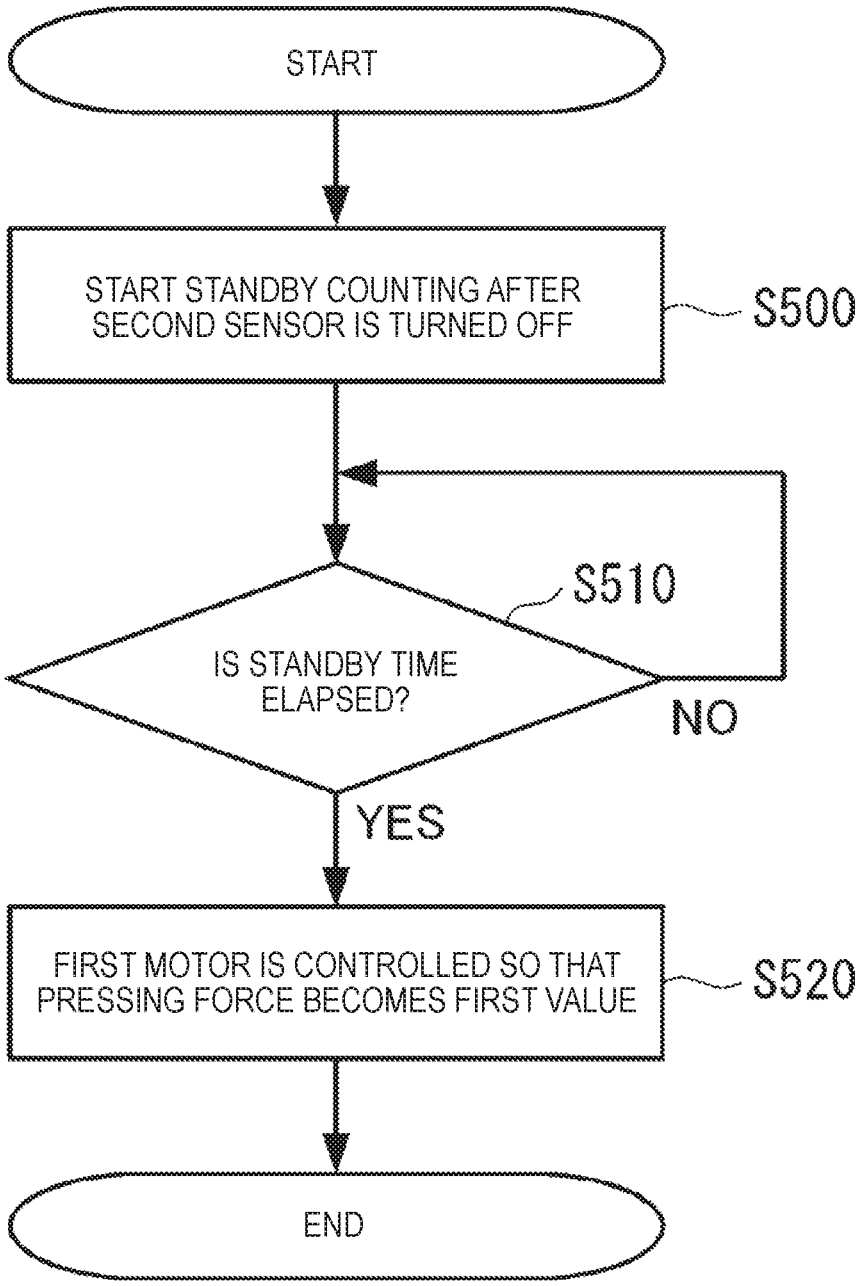
FIG. 14 is a subroutine of step S130 illustrated in FIG. 8 according to a fourth embodiment.

FIG. 14 is a subroutine of step S130 illustrated in FIG. 8 according to the fourth embodiment, and is a flowchart illustrating a control operation of the first motor 192 by the control part 50.

In step S500, counting of the standby time set in advance starts from a point of time when the detection of the first flag 132*a* by the second sensor 134 is turned off by the movement of the wedge plate 122. The standby time indicates, for example, the time until the wedge plate 122 moves backward from the home position and the removal of the staple S from the bundle of paper P is completed, or the time until the leg part Sb of the staple S becomes in a state of being almost pulled out from the bundle of paper P.

In step S510, it is determined whether the standby time is elapsed. When the standby time did not elapse, the counting is continued until the standby time is elapsed. On the other hand, when the standby time is elapsed, the processing proceeds to step S520.

In step S520, for example, the current value of the first motor 192 is limited to 0.5 A smaller than the initial value of 1.0 A, whereby the pressing force of the paper pressing plate 176 against the bundle of paper P is adjusted to the first value (for example, the pressing force when the current value of the first motor 192 is 0.5 A). Here, the operation of removing the staple S from the bundle of paper P is completed or almost completed, such that the pressing force for pressing the bundle of paper P is not required so much. Therefore, the paper pressing plate 176 is controlled to press the bundle of paper P placed on the placement part 102 with a weak pressing force. When step S520 is completed, the processing proceeds to step S140 illustrated in FIG. 8.

Fifth Embodiment

A staple removing device 1E of a fifth embodiment is different from the staple removing device 1A of the first embodiment in that the current value of the first motor 192 is adjusted based upon an arrival distance set in advance. Components substantially having the same function as those of the staple removing device 1A of the first embodiment will be denoted by the same reference signs, and the duplicate description thereof will be omitted or simplified.

[Configuration Example of Staple Removing Device 1E]

Since the staple removing device 1E is common to the block diagram of the staple removing device 1C according to the third embodiment, only different parts will be hereinafter described. The second motor 152 illustrated in FIG. 11 includes an encoder that detects a rotational position of the second motor 152. The control part 50 acquires the number of revolutions of the second motor 152 based upon an output of the encoder, and calculates a movement distance from the home position of the wedge plate 122 to a location where the wedge plate 122 moves backward based upon the number of revolutions.

[Example of Controlling Pressing Force of Paper Pressing Plate 176]

Figure 15:
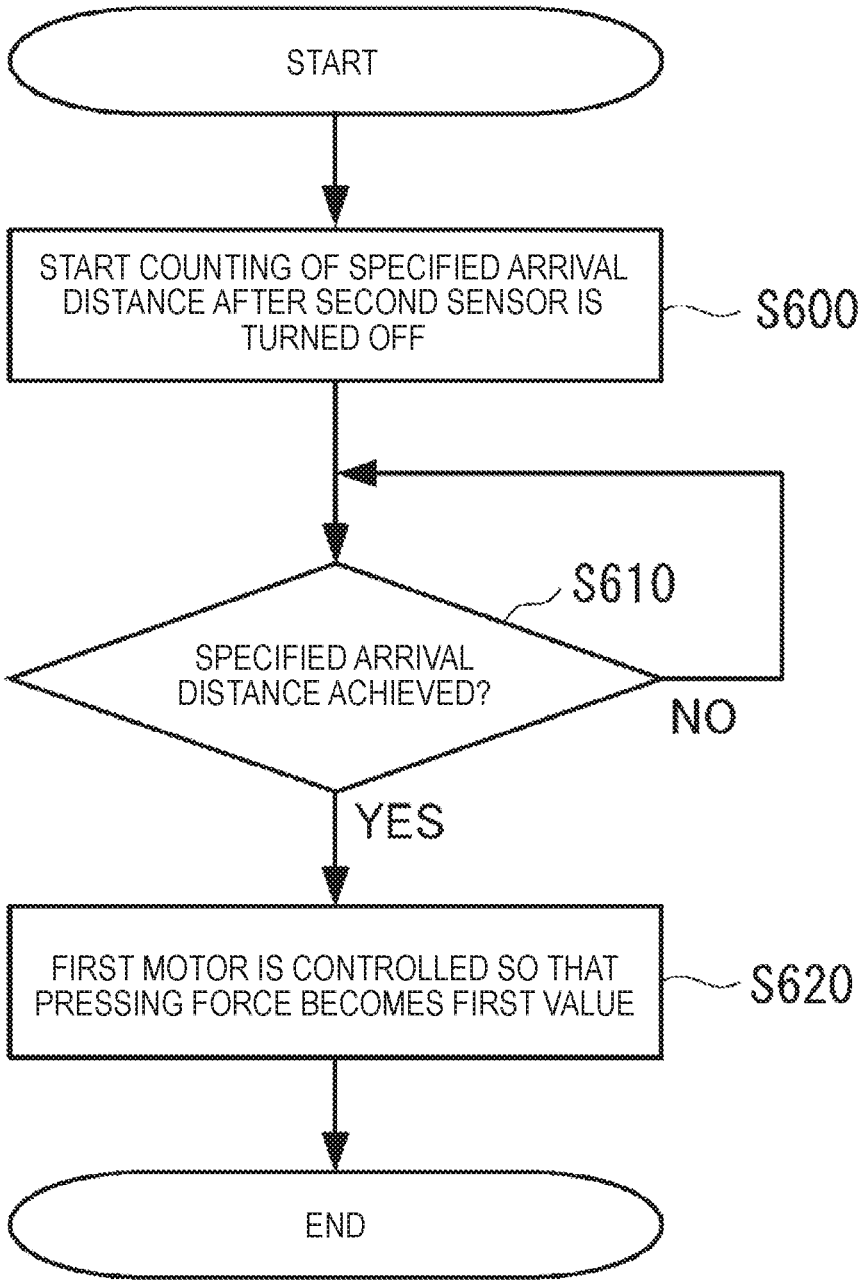
FIG. 15 is a subroutine of step S130 illustrated in FIG. 8 according to a fifth embodiment.

FIG. 15 is a subroutine of step S130 illustrated in FIG. 8 according to the fifth embodiment, and is a flowchart illustrating a control operation of the first motor 192 by the control part 50.

In step S600, from a point of time when the detection of the first flag 132*a* (refer to FIG. 4) by the second sensor 134 is turned off by the movement of the wedge plate 122, counting of a specified arrival distance set in advance starts based upon the output from the encoder of the second motor 152. The specified arrival distance indicates, for example, a distance from the home position where the removal of the staple S from the bundle of paper P is completed by the movement of the wedge plate 122, or a distance from the home position until the leg part Sb of the staple S becomes in a state of being almost pulled out from the bundle of paper P.

In step S610, it is determined whether the specified arrival distance elapses. When the specified arrival distance does not elapse, the counting is continued until the specified arrival distance elapses. On the other hand, when the specified arrival distance elapses, the processing proceeds to step S620.

In step S620, for example, the current value of the first motor 192 is limited to 0.5 A which is smaller than the initial value of 1.0 A, whereby the pressing force of the paper pressing plate 176 against the bundle of paper P is adjusted to the first value (for example, the pressing force when the current value of the first motor 192 is 0.5 A). Here, the operation of removing the staple S from the bundle of paper P is completed, such that the pressing force for pressing the bundle of paper P is not required so much. Therefore, the paper pressing plate 176 presses the bundle of paper P placed on the placement part 102 with a weak pressing force. When step S620 is completed, the processing proceeds to step S140 illustrated in FIG. 8.

Sixth Embodiment

A staple removing device 1F of a sixth embodiment is different from the staple removing device 1A of the first embodiment in that the current value of the first motor 192 is adjusted based upon inputted information on the bundle of paper. Components substantially having the same function as those of the staple removing device 1A of the first embodiment will be denoted by the same reference signs, and the duplicate description thereof will be omitted or simplified.

[Block Diagram of Staple Removing Device 1F]

Figure 16:
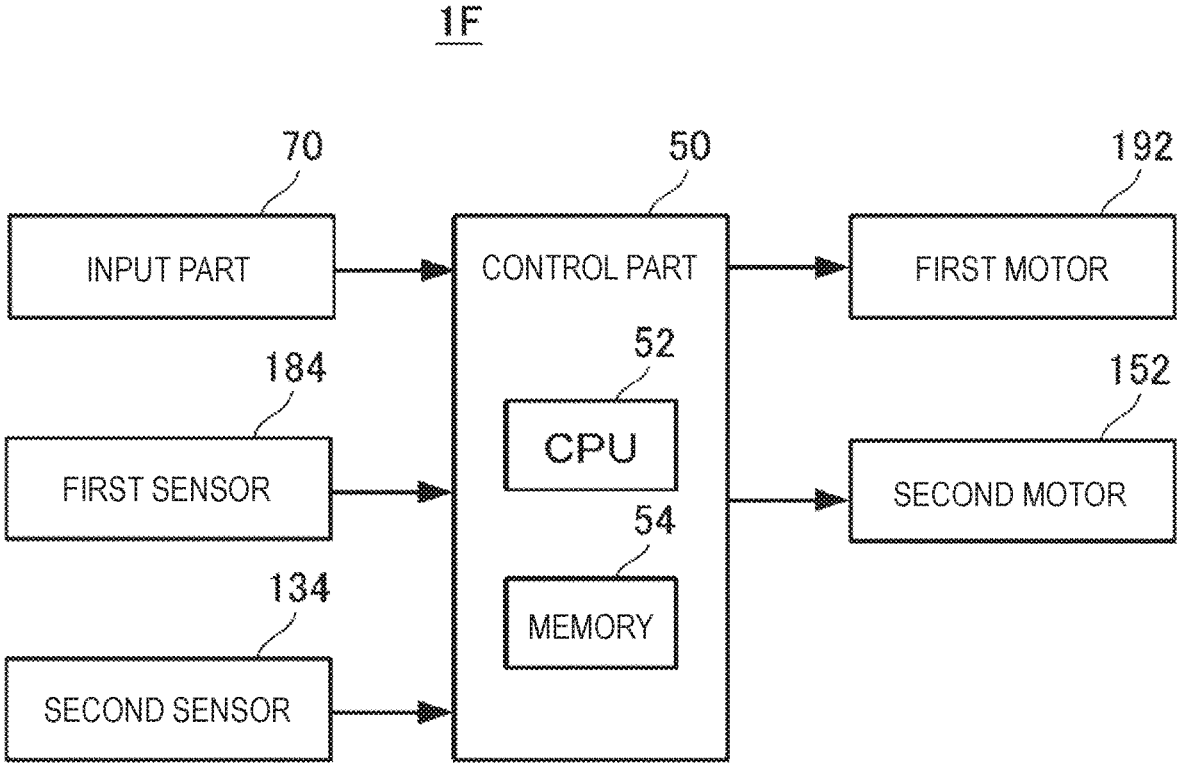
FIG. 16 is a block diagram of a staple removing device 1F according to a sixth embodiment.

FIG. 16 is a block diagram of the staple removing device 1F according to the sixth embodiment.

In addition to the control part 50, the first motor 192, and the second motor 152, the staple removing device 1F includes an input part 70 to which the information on the bundle of paper regarding a state of the bundle of paper P such as a thickness of the bundle of paper P and a diameter of the staple S is inputted.

The input part 70 is formed of, for example, an operation button and a touch panel provided in the casing 100, or an input device such as a mouse and a keyboard connected to the casing 100 by wire or wirelessly, and outputs an input signal based upon the input to the control part 50. The input part 70 may be a device using an infrared ray and other radio waves, a portable terminal connected to a network such as the Internet, or an external device such as a computer.

In the embodiment, the information on the bundle of paper is classified into, for example, a first group in which the load of the wedge plate 122 becomes large when the staple is removed, and a second group in which the load of the wedge plate 122 at the time of removing the staple becomes smaller than that of the first group. The information on the bundle of paper is classified as the first group, for example, when the diameter of the staple S is large and the bundle of paper P is thick. The information thereon is classified as the second group, for example, when the diameter of the staple S is small and the bundle of paper P is thin. Whether the information on the bundle of paper belongs to the first group or the second group may be automatically determined by the control part 50 based upon the thickness of the bundle of paper P and the diameter of the staple S inputted from the input part 70, or the user may directly select and input the first group or the second group. In the embodiment, load information is classified into two groups, but the load information is not limited thereto and can be classified into three or more groups. A size of the diameter of the staple S and the thickness of the bundle of paper P are used as elements when classifying each group, but the present disclosure is not limited thereto and other elements such as the type of paper may be further added.

[Example of Controlling Pressing Force of Paper Pressing Plate 176]

Figure 17:
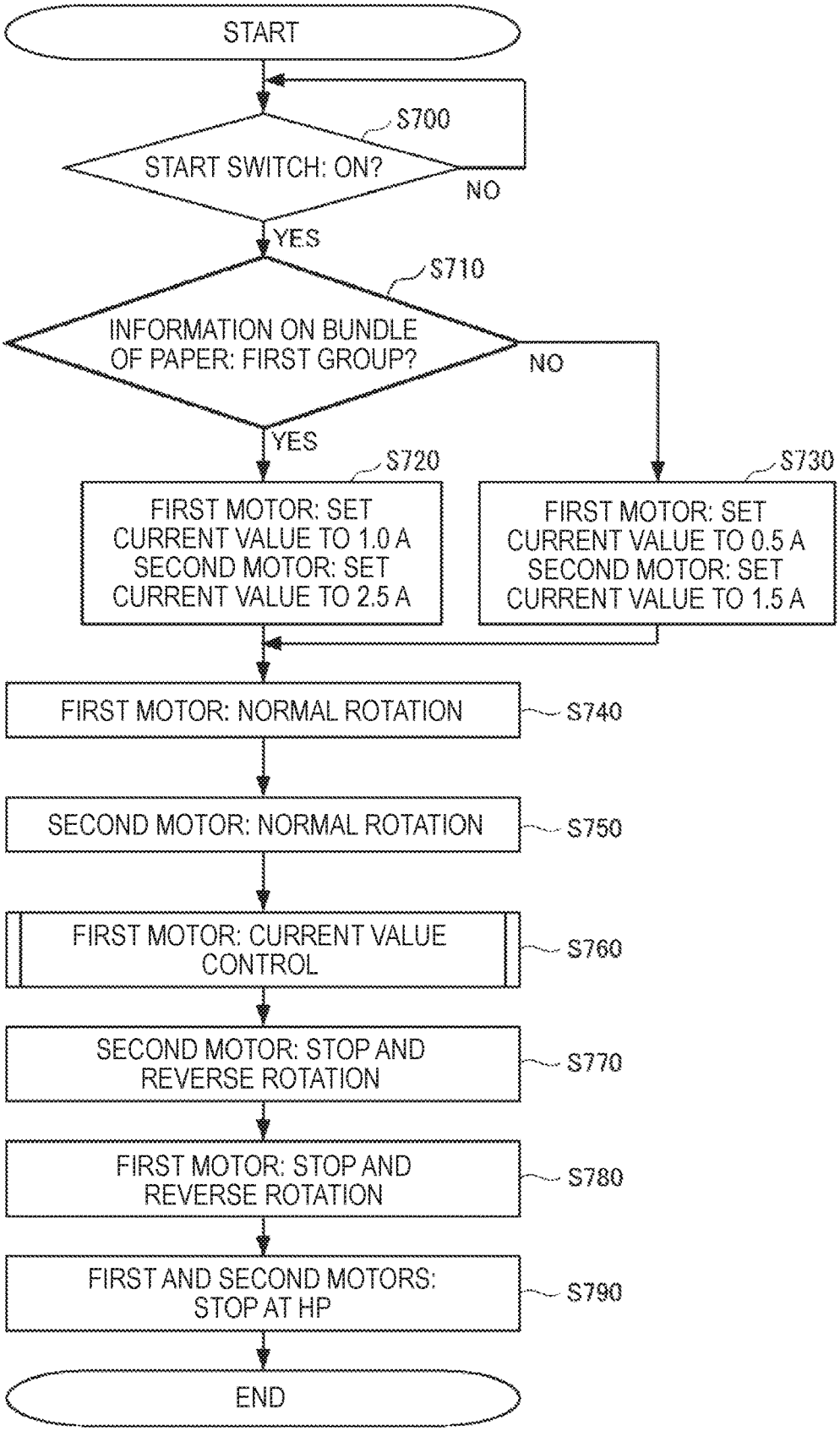
FIG. 17 is a flowchart illustrating an operation of the staple removing device 1F when the pressing force of the paper pressing plate is adjusted based upon information on the bundle of paper according to the sixth embodiment.

FIG. 17 is a flowchart illustrating an operation of the staple removing device 1F when the pressing force of the paper pressing plate 176 is adjusted based upon the information on the bundle of paper according to the sixth embodiment. The operation illustrated in FIG. 17 is mainly realized by allowing the CPU 52 of the control part 50 to execute the program stored in the memory 54. As illustrated in FIG. 7A, it is assumed that the bundle of paper P bound by the staple S is placed on the placement part 102.

In step S700, it is determined whether the start switch 106 is turned on by a user. When the start switch 106 is not turned on, whether the start switch 106 is turned on is continuously monitored. On the other hand, when the start switch 106 is turned on, the processing proceeds to step S710.

In step S710, the control part 50 determines whether the inputted information on the bundle of paper belongs to the first group. That is, from the information on the bundle of paper, it is determined whether the load of the wedge plate 122 at the time of a staple removing operation becomes large. When it is determined that the information on the bundle of paper belongs to the first group, the processing proceeds to step S720. When it is determined that the information on the bundle of paper does not belong to the first group, that is, belongs to the second group, the processing proceeds to step S730.

In step S720, since it is predicted that the load of the wedge plate 122 at the time of the staple removing operation becomes large, the load (torque) of the wedge plate 122 is adjusted by setting the current value of the first motor 192 to 1.0 A and adjusting the current value of the second motor 152 to 2.5 A. As a result, the paper pressing plate 176 can press the bundle of paper P placed on the placement part 102 with a larger pressing force. When the setting of each current value is completed, the processing proceeds to step S740.

On the other hand, in step S730, since it is predicted that the load of the wedge plate 122 at the time of the staple removing operation becomes small, the pressing load (torque) of the wedge plate 122 is adjusted by setting the current value of the first motor 192 to 0.5 A and adjusting the current value of the second motor 152 to 1.5 A. As a result, the paper pressing plate 176 can press the bundle of paper P placed on the placement part 102 with a smaller pressing force. When the setting of each current value is completed, the processing proceeds to step S740.

In step S740, the first motor 192 is normally rotated at the current values set in steps S720 and S730. In the same manner, in step S750, the second motor 152 is normally rotated at the current values set in steps S720 and S730.

Since the processing from step S760 to step S790 is the same as the processing from step S130 to step S160 illustrated in FIG. 8, the detailed description thereof will be omitted. In step S760, the subroutine of FIG. 9 of the first embodiment and the subroutine of FIG. 10 of the second embodiment can be applied.

As described above, according to the sixth embodiment, the pressing force of the paper pressing plate 176 against the bundle of paper P is adjusted by controlling the current value of the first motor 192 based upon the inputted information on the bundle of paper. As a result, it is possible to prevent the bundle of paper P from being pressed with the maximum (constant) pressing force at all times regardless of the type of the bundle of paper P as in a related art, and the bundle of paper P can be pressed with the optimum pressing force by the paper pressing plate 176 according to the type of the bundle of paper P.

Seventh Embodiment

In a staple removing device 1G of a seventh embodiment, retry control is provided in which when the wedge plate 122 does not normally operate (an operation failure occurs), the wedge plate 122 is returned to the home position and the wedge plate 122 is caused to move forward again. The retry control can be incorporated into a part of the removal operation illustrated in FIG. 8. Components substantially having the same function as those of the staple removing device 1A of the first embodiment will be denoted by the same reference signs, and the duplicate description thereof will be omitted or simplified.

Figure 18:
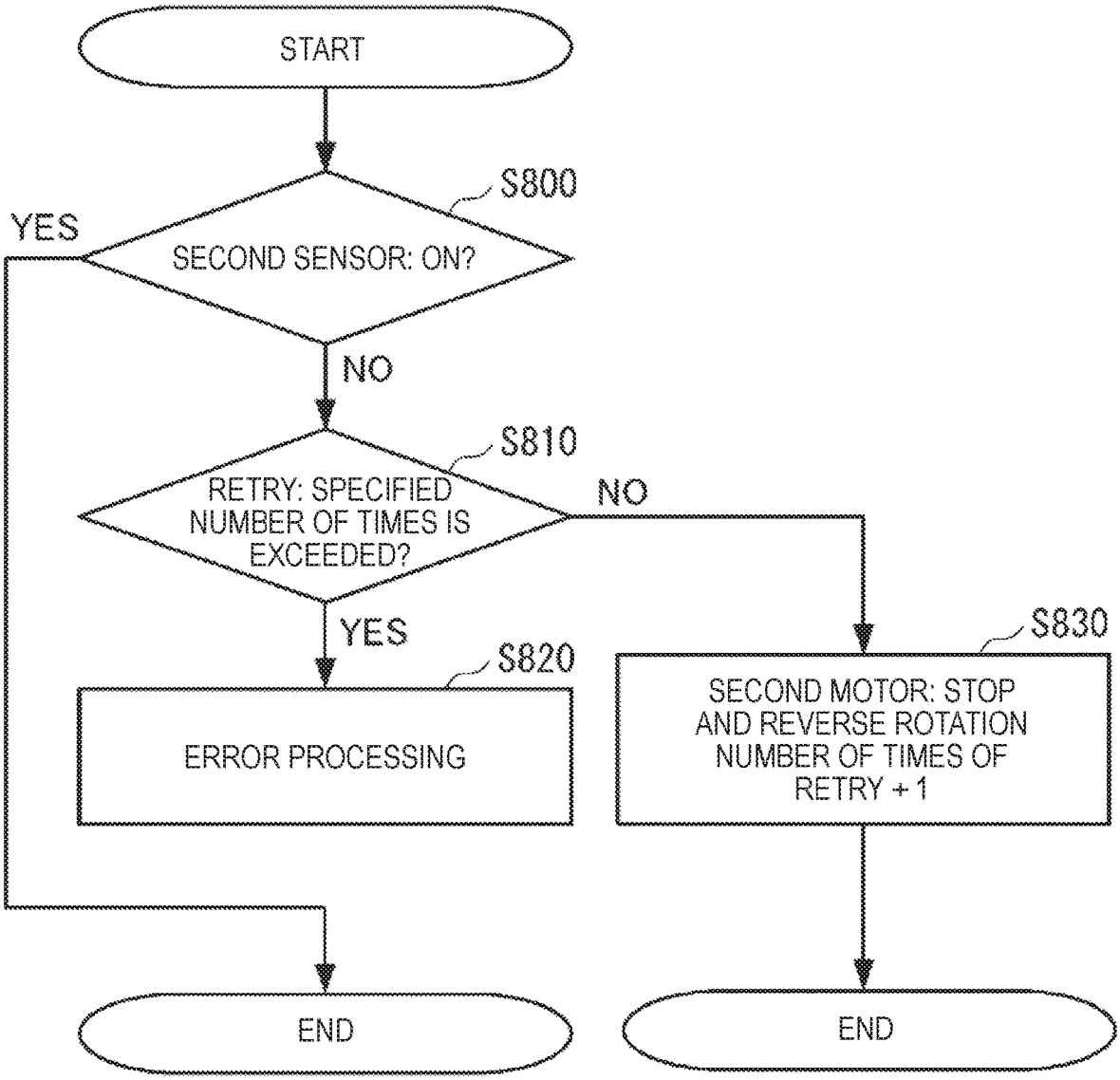
FIG. 18 is a flowchart illustrating an operation of a staple removing device 1G including retry control according to a seventh embodiment.

FIG. 18 is a flowchart illustrating an operation of the staple removing device 1G including the retry control according to the seventh embodiment. The retry control can be inserted, for example, between step S130 and step S140 illustrated in FIG. 8. Therefore, the description of each step in FIG. 8 will be omitted, and only the retry control will be described in detail.

In step S800, it is determined whether the second flag 132*b* (refer to FIG. 4) is detected by the second sensor 134. That is, it is determined whether the wedge plate 122 normally moves to the vicinity of the end of the movement range. When the second flag 132*b* is detected by the second sensor 134, it is determined that the wedge plate 122 normally moves, and the processing returns to step S140 illustrated in FIG. 8. On the other hand, when the second flag 132*b* is not detected by the second sensor 134 even after a lapse of a certain time, the processing proceeds to step S810.

In step S810, it is determined whether the number of times of retry exceeds the specified number of times. When it is determined that the number of times of retry exceeds the specified number of times, the processing proceeds to step S820 and executes error processing. The error processing includes, for example, stop processing of the first motor 192 and the second motor 152, display of an error message on a display part which is not illustrated, and an output of a warning sound. A counter of the number of times of retry is set to "0" as an initial value.

On the other hand, in step S810, when it is determined that the number of times of retry does not exceed the specified number of times, the processing proceeds to step S830.

In step S830, the second motor 152 is caused to stop and rotate in the reverse direction after a lapse of a predetermined time. In this case, since there is a high possibility that the wedge plate 122 stops in the middle of the movement range, the wedge plate 122 is controlled to be returned to the home position. After the counter of the number of times of retry is set to "+1", the processing returns to step S120 illustrated in FIG. 8 again, and executes the retry control for causing the wedge plate 122 to move forward from the home position.

While desirable embodiments of the present disclosure have been described in detail with reference to the accompanying drawings, the technical scope of the present disclosure is not limited to such examples. It is apparent to a person having ordinary knowledge in the technical field of the present disclosure that various modifications or corrections can be made within the scope of technical ideas described in the scope of claims. The above-mentioned modifications or corrections are also included in the technical scope of the present disclosure.

What is claimed is:

1. A staple removing device, comprising:

a placement part on which a bundle of paper bound with a staple are placed, the staple including a crown part and a leg part;

a paper pressing part that is provided at a position facing the bundle of paper placed on the placement part, configured to be movable toward the bundle of paper, and presses the bundle of paper against the placement part by movement;

a removal part that is disposed on a side where the crown part of the staple binding the bundle of paper placed on the placement part is exposed, the removal part configured to be insertable between the bundle of paper and the staple, and to remove the staple from the bundle of paper by insertion;

a load detecting part that detects an insertion load of the removal part when the removal part is inserted between the bundle of paper and the staple; and a control part that adjusts a pressing force of the paper pressing part based upon the insertion load detected by the load detecting part.

2. The staple removing device according to claim 1, further comprising:

a first motor configured to cause the paper pressing part to move, wherein the control part adjusts the pressing force by controlling the first motor.

3. The staple removing device according to claim 2, further comprising:

a second motor configured to cause the removal part to move, wherein the load detecting part detects a current value of the second motor, and the control part adjusts the pressing force based upon the current value.

4. The staple removing device according to claim 3, wherein the control part adjusts the pressing force so that the pressing force becomes less than a first value when the current value is less than a first threshold value, and the pressing force becomes equal to or greater than the first value when the current value is equal to or greater than the first threshold value.

5. The staple removing device according to claim 4, wherein the control part sets the pressing force to the first value when the current value is the first threshold value, and continuously or intermittently increases the pressing force with respect to the first value as the current value moves away from the first threshold value when the current value exceeds the first threshold value.

6. The staple removing device according to claim 4, wherein the control part sets the pressing force to the first value when the current value is the first threshold value, and continuously or intermittently reduces the pressing force with respect to the first value as the current value moves away from the first threshold value when the current value is less than the first threshold value.

7. The staple removing device according to claim 5, wherein the control part sets the pressing force to the first value when the current value is the first threshold value, and continuously or intermittently reduces the pressing force with respect to the first value as the current value moves away from the first threshold value when the current value is less than the first threshold value.

8. The staple removing device according to claim 1, further comprising:

a second motor configured to cause the removal part to move, wherein the load detecting part detects a current value of the second motor, and the control part adjusts the pressing force based upon the current value.

9. The staple removing device according to claim 8, wherein the control part adjusts the pressing force so that the pressing force becomes less than a first value when the current value is less than a first threshold value, and the pressing force becomes equal to or greater than the first value when the current value is equal to or greater than the first threshold value.

10. The staple removing device according to claim 9, wherein the control part sets the pressing force to the first value when the current value is the first threshold value, and continuously or intermittently increases the pressing force with respect to the first value as the current value moves away from the first threshold value when the current value exceeds the first threshold value.

11. The staple removing device according to claim 9, wherein the control part sets the pressing force to the first value when the current value is the first threshold value, and continuously or intermittently reduces the pressing force with respect to the first value as the current value moves away from the first threshold value when the current value is less than the first threshold value.

12. The staple removing device according to claim 10, wherein the control part sets the pressing force to the first value when the current value is the first threshold value, and continuously or intermittently reduces the pressing force with respect to the first value as the current value moves away from the first threshold value when the current value is less than the first threshold value.

13. The staple removing device according to claim 1, wherein the control part counts elapsed time from a start of a movement of the removal part toward between the bundle and the staple, and weaken the pressing force of the paper pressing part when the elapsed time reaches a standby time set in advance.

14. The staple removing device according to claim 1, wherein the control part counts moving distance from a start of a movement of the removal part toward between the bundle and the staple, and weaken the pressing force of the paper pressing part when the moving distance reaches a specified arrival distance set in advance.

15. A staple removing device, comprising:

a placement part on which a bundle of paper bound with a staple are placed, the staple including a crown part and a leg part;

a paper pressing part that is provided at a position facing the bundle of paper placed on the placement part, configured to be movable toward the bundle of paper, and presses the bundle of paper against the placement part by movement;

a removal part that is disposed on a side where the crown part of the staple binding the bundle of paper placed on the placement part is exposed, the removal part configured to be insertable between the bundle of paper and the staple, and to remove the staple from the bundle of paper by insertion;

a thickness detecting part that detects a thickness of the bundle of paper placed on the placement part; and a control part that adjusts a pressing force of the paper pressing part based upon the thickness of the bundle of paper detected by the thickness detecting part.

16. The staple removing device according to claim 15, wherein the control part adjusts the pressing force so that the pressing force becomes less than a first value when the thickness of the bundle of paper is less than a first threshold value, and the pressing force becomes equal to or greater than the first value when the thickness of the bundle of paper is equal to or greater than the first threshold value.

17. The staple removing device according to claim 16, wherein the control part sets the pressing force to the first value when the thickness of the bundle of paper is the first threshold value, and continuously or intermittently increases the pressing force with respect to the first value as the thickness of the bundle of paper moves away from the first threshold value when the thickness of the bundle of paper exceeds the first threshold value.

18. The staple removing device according to claim 16, wherein the control part sets the pressing force to the first value when the thickness of the bundle of paper is the first threshold value, and continuously or intermittently reduces the pressing force with respect to the first value as the thickness of the bundle of paper moves away from the first threshold value when the thickness of the bundle of paper is less than the first threshold value.

19. The staple removing device according to claim 17, wherein the control part sets the pressing force to the first value when the thickness of the bundle of paper is the first threshold value, and continuously or intermittently reduces the pressing force with respect to the first value as the thickness of the bundle of paper moves away from the first threshold value when the thickness of the bundle of paper is less than the first threshold value.

20. The staple removing device according to claim 15, wherein the control part counts elapsed time from a start of a movement of the removal part toward between the bundle and the staple, and weaken the pressing force of the paper pressing part when the elapsed time reaches a standby time set in advance.

21. The staple removing device according to claim 15, wherein the control part counts moving distance from a start of a movement of the removal part toward between the bundle and the staple, and weaken the pressing force of the paper pressing part when the moving distance reaches a specified arrival distance set in advance.

22. A staple removing device, comprising:

a placement part on which a bundle of paper bound with a staple are placed, the staple including a crown part and a leg part;

a paper pressing part that is provided at a position facing the bundle of paper placed on the placement part, configured to be movable toward the bundle of paper, and presses the bundle of paper against the placement part by movement;

a removal part that is disposed on a side where the crown part of the staple binding the bundle of paper placed on the placement part is exposed, the removal part configured to be insertable between the bundle of paper and the staple, and to remove the staple from the bundle of paper by insertion;

a input part that receives an input of information on the bundle of paper including a thickness of the bundle of paper placed on the placement part; and a control part that adjusts a pressing force of the paper pressing part based upon the information on the bundle of paper received by the input part.

23. The staple removing device according to claim 22, wherein the information on the bundle of paper further includes a dimension of the staple.

24. The staple removing device according to claim 22, wherein the control part counts elapsed time from a start of a movement of the removal part toward between the bundle and the staple, and weaken the pressing force of the paper pressing part when the elapsed time reaches a standby time set in advance.

25. The staple removing device according to claim 22, wherein the control part counts moving distance from a start of a movement of the removal part toward between the bundle and the staple, and weaken the pressing force of the paper pressing part when the moving distance reaches a specified arrival distance set in advance.

* * * * *